US009172154B2

(12) United States Patent
Burris

(10) Patent No.: US 9,172,154 B2
(45) Date of Patent: Oct. 27, 2015

(54) COAXIAL CABLE CONNECTOR WITH INTEGRAL RFI PROTECTION

(71) Applicant: Corning Gilbert Inc., Glendale, AZ (US)

(72) Inventor: Donald Andrew Burris, Peoria, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 13/833,793

(22) Filed: Mar. 15, 2013

(65) Prior Publication Data

US 2014/0273620 A1 Sep. 18, 2014

(51) Int. Cl.

| | |
|---|---|
| ***H01R 9/05*** | (2006.01) |
| ***H01R 13/622*** | (2006.01) |
| *H01R 4/30* | (2006.01) |

(52) U.S. Cl.

CPC ..... *H01R 9/05* (2013.01); *H01R 9/0521* (2013.01); *H01R 13/622* (2013.01); *H01R 4/304* (2013.01)

(58) Field of Classification Search

USPC ..... 439/585, 578, 582–584

See application file for complete search history.

(56) References Cited

U.S. PATENT DOCUMENTS

| | | | |
|---|---|---|---|
| 331,169 | A | 11/1885 | Thomas |
| 346,958 | A | 8/1886 | Stone |
| 459,951 | A | 9/1891 | Warner |
| 589,216 | A | 8/1897 | McKee |
| 1,371,742 | A | 3/1921 | Dringman |
| 1,488,175 | A | 3/1924 | Strandell |
| 1,667,485 | A | 4/1928 | MacDonald |
| 1,766,869 | A | 6/1930 | Austin |
| 1,801,999 | A | 4/1931 | Bowman |
| 1,885,761 | A | 11/1932 | Peirce, Jr. |
| 1,959,302 | A | 5/1934 | Paige |
| 2,013,526 | A | 9/1935 | Schmitt |
| 2,059,920 | A | 11/1936 | Weatherhead, Jr. |

(Continued)

FOREIGN PATENT DOCUMENTS

| | | |
|---|---|---|
| CA | 2096710 | 11/1994 |
| CN | 201149936 | 11/2008 |

(Continued)

OTHER PUBLICATIONS

Office Action dated Sep. 19, 2014 pertaining to U.S. Appl. No. 13/795,780.

(Continued)

*Primary Examiner* — Jean F Duverne

(57) ABSTRACT

A coaxial cable connector for coupling an end of a coaxial cable to a terminal and providing RF shielding is disclosed. The coaxial cable connector has a coupler, body, post and/or retainer with an integral contacting portion that is monolithic with at least a portion of the post or retainer to establish electrical continuity. In this way, electrical continuity is established through the coupler, the post, and/or the retainer of the coaxial cable connector other than by the use of a component unattached from the coupler, the post, the body, and the retainer to provide RF shielding such that the integrity of an electrical signal transmitted through coaxial cable connector is maintained regardless of the tightness of the coupling of the connector to the terminal. When assembled the coupler and post or retainer provide at least one circuitous path resulting in RF shielding such that spurious RF signals are attenuated.

23 Claims, 23 Drawing Sheets

(56) References Cited

U.S. PATENT DOCUMENTS

| | | | |
|---|---|---|---|
| 2,102,495 | A | 12/1937 | England |
| 2,258,528 | A | 10/1941 | Wurzburger |
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,694,187 | A | 11/1954 | Nash |
| 2,705,652 | A | 4/1955 | Kaiser |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,785,384 | A | 3/1957 | Wickesser |
| 2,805,399 | A | 9/1957 | Leeper |
| 2,816,949 | A | 12/1957 | Curtiss |
| 2,870,420 | A | 1/1959 | Malek |
| 2,878,039 | A | 3/1959 | Hoegee et al. |
| 2,881,406 | A | 4/1959 | Arson |
| 2,963,536 | A | 12/1960 | Kokalas |
| 3,001,169 | A | 9/1961 | Blonder |
| 3,015,794 | A | 1/1962 | Kishbaugh |
| 3,051,925 | A | 8/1962 | Felts |
| 3,091,748 | A | 5/1963 | Takes et al. |
| 3,094,364 | A | 6/1963 | Lingg |
| 3,103,548 | A | 9/1963 | Concelman |
| 3,106,548 | A | 10/1963 | Lavalou |
| 3,140,106 | A | 7/1964 | Thomas et al. |
| 3,184,706 | A | 5/1965 | Atkins |
| 3,194,292 | A | 7/1965 | Borowsky |
| 3,196,382 | A | 7/1965 | Morello, Jr. |
| 3,206,540 | A | 9/1965 | Cohen |
| 3,245,027 | A | 4/1966 | Ziegler, Jr. |
| 3,275,913 | A | 9/1966 | Blanchard et al. |
| 3,278,890 | A | 10/1966 | Cooney |
| 3,281,756 | A | 10/1966 | O'Keefe et al. |
| 3,281,757 | A | 10/1966 | Bonhomme |
| 3,290,069 | A | 12/1966 | Davis |
| 3,292,136 | A | 12/1966 | Somerset |
| 3,320,575 | A | 5/1967 | Brown et al. |
| 3,321,732 | A | 5/1967 | Forney, Jr. |
| 3,336,563 | A | 8/1967 | Hyslop |
| 3,348,186 | A | 10/1967 | Rosen |
| 3,350,667 | A | 10/1967 | Shreve |
| 3,350,677 | A | 10/1967 | Daum |
| 3,355,698 | A | 11/1967 | Keller |
| 3,372,364 | A | 3/1968 | O'Keefe et al. |
| 3,373,243 | A | 3/1968 | Janowiak et al. |
| 3,390,374 | A | 6/1968 | Forney, Jr. |
| 3,406,373 | A | 10/1968 | Forney, Jr. |
| 3,430,184 | A | 2/1969 | Acord |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark et al. |
| 3,494,400 | A | 2/1970 | McCoy et al. |
| 3,498,647 | A | 3/1970 | Schroder |
| 3,499,671 | A | 3/1970 | Osborne |
| 3,501,737 | A | 3/1970 | Harris et al. |
| 3,517,373 | A | 6/1970 | Jamon |
| 3,526,871 | A | 9/1970 | Hobart |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,596,933 | A | 8/1971 | Luckenbill |
| 3,601,776 | A | 8/1971 | Curl |
| 3,603,912 | A | 9/1971 | Kelly |
| 3,614,711 | A | 10/1971 | Anderson et al. |
| 3,622,952 | A | 11/1971 | Hilbert |
| 3,629,792 | A | 12/1971 | Dorrell |
| 3,633,150 | A | 1/1972 | Swartz |
| 3,646,502 | A | 2/1972 | Hutter et al. |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,671,926 | A | 6/1972 | Nepovim |
| 3,678,444 | A | 7/1972 | Stevens et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,694,793 | A | 9/1972 | Concelman |
| 3,697,930 | A | 10/1972 | Shirey |
| 3,706,958 | A | 12/1972 | Blanchenot |
| 3,708,186 | A | 1/1973 | Takagi et al. |
| 3,710,005 | A | 1/1973 | French |
| 3,739,076 | A | 6/1973 | Schwartz |
| 3,744,007 | A | 7/1973 | Horak |
| 3,744,011 | A | 7/1973 | Blanchenot |
| 3,761,870 | A | 9/1973 | Drezin et al. |
| 3,778,535 | A | 12/1973 | Forney, Jr. |
| 3,781,762 | A | 12/1973 | Quackenbush |
| 3,781,898 | A | 12/1973 | Holloway |
| 3,783,178 | A | 1/1974 | Philibert et al. |
| 3,787,796 | A | 1/1974 | Barr |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,854,789 | A | 12/1974 | Kaplan |
| 3,858,156 | A | 12/1974 | Zarro |
| 3,879,102 | A | 4/1975 | Horak |
| 3,886,301 | A | 5/1975 | Cronin et al. |
| 3,907,335 | A | 9/1975 | Burge et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,937,547 | A | 2/1976 | Lee-Kemp |
| 3,953,097 | A | 4/1976 | Graham |
| 3,960,428 | A | 6/1976 | Naus et al. |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 3,986,736 | A | 10/1976 | Takagi et al. |
| 4,017,139 | A | 4/1977 | Nelson |
| 4,022,966 | A | 5/1977 | Gajajiva |
| 4,030,742 | A | 6/1977 | Eidelberg et al. |
| 4,030,798 | A | 6/1977 | Paoli |
| 4,032,177 | A | 6/1977 | Anderson |
| 4,045,706 | A | 8/1977 | Daffner et al. |
| 4,046,451 | A | 9/1977 | Juds et al. |
| 4,053,200 | A | 10/1977 | Pugner |
| 4,056,043 | A | 11/1977 | Sriramamurty et al. |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,100,943 | A | 7/1978 | Terada et al. |
| 4,106,839 | A | 8/1978 | Cooper |
| 4,109,126 | A | 8/1978 | Halbeck |
| 4,125,308 | A | 11/1978 | Schilling |
| 4,126,372 | A | 11/1978 | Hashimoto et al. |
| 4,131,332 | A | 12/1978 | Hogendobler et al. |
| 4,136,897 | A | 1/1979 | Haluch |
| 4,150,250 | A | 4/1979 | Lundeberg |
| 4,153,320 | A | 5/1979 | Townshend |

(56) References Cited

U.S. PATENT DOCUMENTS

| | | | |
|---|---|---|---|
| 4,156,554 | A | 5/1979 | Aujla |
| 4,165,911 | A | 8/1979 | Laudig |
| 4,168,921 | A | 9/1979 | Blanchard |
| 4,173,385 | A | 11/1979 | Fenn et al. |
| 4,174,875 | A | 11/1979 | Wilson et al. |
| 4,187,481 | A | 2/1980 | Boutros |
| 4,193,655 | A | 3/1980 | Herrmann, Jr. |
| 4,194,338 | A | 3/1980 | Trafton |
| 4,206,963 | A | 6/1980 | English et al. |
| 4,212,487 | A | 7/1980 | Jones et al. |
| 4,225,162 | A | 9/1980 | Dola |
| 4,227,765 | A | 10/1980 | Neumann et al. |
| 4,229,714 | A | 10/1980 | Yu |
| 4,250,348 | A | 2/1981 | Kitagawa |
| 4,273,405 | A | 6/1981 | Law |
| 4,280,749 | A | 7/1981 | Hemmer |
| 4,285,564 | A | 8/1981 | Spinner |
| 4,290,663 | A | 9/1981 | Fowler et al. |
| 4,296,986 | A | 10/1981 | Herrmann, Jr. |
| 4,307,926 | A | 12/1981 | Smith |
| 4,309,050 | A | 1/1982 | Legris |
| 4,310,211 | A | 1/1982 | Bunnell et al. |
| 4,322,121 | A | 3/1982 | Riches et al. |
| 4,326,769 | A | 4/1982 | Dorsey et al. |
| 4,334,730 | A | 6/1982 | Colwell et al. |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,373,767 | A | 2/1983 | Cairns |
| 4,389,081 | A | 6/1983 | Gallusser et al. |
| 4,400,050 | A | 8/1983 | Hayward |
| 4,407,529 | A | 10/1983 | Holman |
| 4,408,821 | A | 10/1983 | Forney, Jr. |
| 4,408,822 | A | 10/1983 | Nikitas |
| 4,412,717 | A | 11/1983 | Monroe |
| 4,421,377 | A | 12/1983 | Spinner |
| 4,426,127 | A | 1/1984 | Kubota |
| 4,444,453 | A | 4/1984 | Kirby et al. |
| 4,452,503 | A | 6/1984 | Forney, Jr. |
| 4,456,323 | A | 6/1984 | Pitcher et al. |
| 4,462,653 | A | 7/1984 | Flederbach et al. |
| 4,464,000 | A | 8/1984 | Werth et al. |
| 4,464,001 | A | 8/1984 | Collins |
| 4,469,386 | A | 9/1984 | Ackerman |
| 4,470,657 | A | 9/1984 | Deacon |
| 4,477,132 | A | 10/1984 | Moser et al. |
| 4,484,792 | A | 11/1984 | Tengler et al. |
| 4,484,796 | A | 11/1984 | Sato et al. |
| 4,490,576 | A | 12/1984 | Bolante et al. |
| 4,506,943 | A | 3/1985 | Drogo |
| 4,515,427 | A | 5/1985 | Smit |
| 4,525,017 | A | 6/1985 | Schildkraut et al. |
| 4,531,790 | A | 7/1985 | Selvin |
| 4,531,805 | A | 7/1985 | Werth |
| 4,533,191 | A | 8/1985 | Blackwood |
| 4,540,231 | A | 9/1985 | Forney, Jr. |
| RE31,995 | E | 10/1985 | Ball |
| 4,545,633 | A | 10/1985 | McGeary |
| 4,545,637 | A | 10/1985 | Bosshard et al. |
| 4,575,274 | A | 3/1986 | Hayward |
| 4,580,862 | A | 4/1986 | Johnson |
| 4,580,865 | A | 4/1986 | Fryberger |
| 4,583,811 | A | 4/1986 | McMills |
| 4,585,289 | A | 4/1986 | Bocher |
| 4,588,246 | A | 5/1986 | Schildkraut et al. |
| 4,593,964 | A | 6/1986 | Forney, Jr. et al. |
| 4,596,434 | A | 6/1986 | Saba et al. |
| 4,596,435 | A | 6/1986 | Bickford |
| 4,597,621 | A | 7/1986 | Burns |
| 4,598,959 | A | 7/1986 | Selvin |
| 4,598,961 | A | 7/1986 | Cohen |
| 4,600,263 | A | 7/1986 | DeChamp et al. |
| 4,613,199 | A | 9/1986 | McGeary |
| 4,614,390 | A | 9/1986 | Baker |
| 4,616,900 | A | 10/1986 | Cairns |
| 4,632,487 | A | 12/1986 | Wargula |
| 4,634,213 | A | 1/1987 | Larsson et al. |
| 4,640,572 | A | 2/1987 | Conlon |
| 4,645,281 | A | 2/1987 | Burger |
| 4,647,135 | A | 3/1987 | Reinhardt |
| 4,650,228 | A | 3/1987 | McMills et al. |
| 4,655,159 | A | 4/1987 | McMills |
| 4,655,534 | A | 4/1987 | Stursa |
| 4,660,921 | A | 4/1987 | Hauver |
| 4,666,190 | A | 5/1987 | Yamabe et al. |
| 4,668,043 | A | 5/1987 | Saba et al. |
| 4,673,236 | A | 6/1987 | Musolff et al. |
| 4,674,818 | A | 6/1987 | McMills et al. |
| 4,676,577 | A | 6/1987 | Szegda |
| 4,682,832 | A | 7/1987 | Punako et al. |
| 4,684,201 | A | 8/1987 | Hutter |
| 4,688,876 | A | 8/1987 | Morelli |
| 4,688,878 | A | 8/1987 | Cohen et al. |
| 4,690,482 | A | 9/1987 | Chamberland et al. |
| 4,691,976 | A | 9/1987 | Cowen |
| 4,703,987 | A | 11/1987 | Gallusser et al. |
| 4,703,988 | A | 11/1987 | Raux et al. |
| 4,713,021 | A | 12/1987 | Kobler |
| 4,717,355 | A | 1/1988 | Mattis |
| 4,720,155 | A | 1/1988 | Schildkraut et al. |
| 4,728,301 | A | 3/1988 | Hemmer et al. |
| 4,734,050 | A | 3/1988 | Negre et al. |
| 4,734,666 | A | 3/1988 | Ohya et al. |
| 4,737,123 | A | 4/1988 | Paler et al. |
| 4,738,009 | A | 4/1988 | Down et al. |
| 4,738,628 | A | 4/1988 | Rees |
| 4,739,126 | A | 4/1988 | Gutter et al. |
| 4,746,305 | A | 5/1988 | Nomura |
| 4,747,656 | A | 5/1988 | Miyahara et al. |
| 4,747,786 | A | 5/1988 | Hayashi et al. |
| 4,749,821 | A | 6/1988 | Linton et al. |
| 4,755,152 | A | 7/1988 | Elliot et al. |
| 4,757,297 | A | 7/1988 | Frawley |
| 4,759,729 | A | 7/1988 | Kemppainen et al. |
| 4,761,146 | A | 8/1988 | Sohoel |
| 4,772,222 | A | 9/1988 | Laudig et al. |
| 4,789,355 | A | 12/1988 | Lee |
| 4,789,759 | A | 12/1988 | Jones |
| 4,795,360 | A | 1/1989 | Newman et al. |
| 4,797,120 | A | 1/1989 | Ulery |
| 4,806,116 | A | 2/1989 | Ackerman |
| 4,807,891 | A | 2/1989 | Neher |
| 4,808,128 | A | 2/1989 | Werth |
| 4,810,017 | A | 3/1989 | Knak et al. |
| 4,813,886 | A | 3/1989 | Roos et al. |
| 4,820,185 | A | 4/1989 | Moulin |
| 4,834,675 | A | 5/1989 | Samchisen |
| 4,834,676 | A | 5/1989 | Tackett |
| 4,835,342 | A | 5/1989 | Guginsky |
| 4,836,580 | A | 6/1989 | Farrell |
| 4,836,801 | A | 6/1989 | Ramirez |
| 4,838,813 | A | 6/1989 | Pauza et al. |
| 4,846,731 | A | 7/1989 | Alwine |
| 4,854,893 | A | 8/1989 | Morris |
| 4,857,014 | A | 8/1989 | Alf et al. |
| 4,867,489 | A | 9/1989 | Patel |
| 4,867,706 | A | 9/1989 | Tang |
| 4,869,679 | A | 9/1989 | Szegda |
| 4,874,331 | A | 10/1989 | Iverson |
| 4,881,912 | A | 11/1989 | Thommen et al. |
| 4,892,275 | A | 1/1990 | Szegda |
| 4,902,246 | A | 2/1990 | Samchisen |
| 4,906,207 | A | 3/1990 | Banning et al. |
| 4,915,651 | A | 4/1990 | Bout |
| 4,921,447 | A | 5/1990 | Capp et al. |
| 4,923,412 | A | 5/1990 | Morris |
| 4,925,403 | A | 5/1990 | Zorzy |
| 4,927,385 | A | 5/1990 | Cheng |
| 4,929,188 | A | 5/1990 | Lionetto et al. |
| 4,934,960 | A | 6/1990 | Capp et al. |
| 4,938,718 | A | 7/1990 | Guendel |
| 4,941,846 | A | 7/1990 | Guimond et al. |
| 4,952,174 | A | 8/1990 | Sucht et al. |

(56) References Cited

U.S. PATENT DOCUMENTS 4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,018,822 A 5/1991 Freismuth et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,059,139 A 10/1991 Spinner
5,059,747 A 10/1991 Bawa et al.
5,062,804 A 11/1991 Jamet et al.
5,066,248 A 11/1991 Gaver, Jr. et al.
5,067,912 A 11/1991 Bickford et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,150,924 A 9/1992 Yokomatsu et al.
5,154,636 A 10/1992 Vaccaro et al.
5,161,993 A 11/1992 Leibfried, Jr.
5,166,477 A 11/1992 Perin, Jr. et al.
5,167,545 A 12/1992 O'Brien et al.
5,169,323 A 12/1992 Kawai et al.
5,181,161 A 1/1993 Hirose et al.
5,183,417 A 2/1993 Bools
5,186,501 A 2/1993 Mano
5,186,655 A 2/1993 Glenday et al.
5,195,905 A 3/1993 Pesci
5,195,906 A 3/1993 Szegda
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,392 A 6/1993 Hosler, Sr.
5,217,393 A 6/1993 Del Negro et al.
5,221,216 A 6/1993 Gabany et al.
5,227,587 A 7/1993 Paterek
5,247,424 A 9/1993 Harris et al.
5,269,701 A 12/1993 Leibfried, Jr.
5,281,762 A 1/1994 Long et al.
5,283,853 A 2/1994 Szegda
5,284,449 A 2/1994 Vaccaro
5,294,864 A 3/1994 Do
5,295,864 A 3/1994 Birch et al.
5,316,348 A 5/1994 Franklin
5,316,494 A 5/1994 Flanagan et al.
5,318,459 A 6/1994 Shields
5,321,205 A 6/1994 Bawa et al.
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,362,250 A 11/1994 McMills et al.
5,362,251 A 11/1994 Bielak
5,366,260 A 11/1994 Wartluft
5,371,819 A 12/1994 Szegda
5,371,821 A 12/1994 Szegda
5,371,827 A 12/1994 Szegda
5,380,211 A 1/1995 Kawaguchi et al.
5,389,005 A 2/1995 Kodama
5,393,244 A 2/1995 Szegda
5,397,252 A 3/1995 Wang
5,413,504 A 5/1995 Kloecker et al.
5,431,583 A 7/1995 Szegda
5,435,745 A 7/1995 Booth
5,435,751 A 7/1995 Papenheim et al.
5,435,760 A 7/1995 Miklos
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,488,268 A 1/1996 Bauer et al.
5,490,033 A 2/1996 Cronin
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,320 A 3/1997 Wright
5,607,325 A 3/1997 Toma
5,609,501 A 3/1997 McMills et al.
5,620,339 A 4/1997 Gray et al.
5,632,637 A 5/1997 Diener
5,632,651 A 5/1997 Szegda
5,644,104 A 7/1997 Porter et al.
5,649,723 A 7/1997 Larsson
5,651,698 A 7/1997 Locati et al.
5,651,699 A 7/1997 Holliday
5,653,605 A 8/1997 Woehl et al.
5,667,405 A 9/1997 Holliday
5,681,172 A 10/1997 Moldenhauer
5,683,263 A 11/1997 Hsu
5,702,263 A 12/1997 Baumann et al.
5,722,856 A 3/1998 Fuchs et al.
5,735,704 A 4/1998 Anthony
5,743,131 A 4/1998 Holliday et al.
5,746,617 A 5/1998 Porter, Jr. et al.
5,746,619 A 5/1998 Harting et al.
5,769,652 A 6/1998 Wider
5,774,344 A 6/1998 Casebolt
5,775,927 A 7/1998 Wider
5,788,289 A 8/1998 Cronley
5,791,698 A 8/1998 Wartluft et al.
5,797,633 A 8/1998 Katzer et al.
5,817,978 A 10/1998 Hermant et al.
5,863,220 A 1/1999 Holliday
5,877,452 A 3/1999 McConnell
5,879,191 A 3/1999 Burris
5,882,226 A 3/1999 Bell et al.
5,897,795 A 4/1999 Lu et al.
5,906,511 A 5/1999 Bozzer et al.
5,917,153 A 6/1999 Geroldinger
5,921,793 A 7/1999 Phillips
5,938,465 A 8/1999 Fox, Sr.
5,944,548 A 8/1999 Saito
5,951,327 A 9/1999 Marik
5,954,708 A 9/1999 Lopez et al.
5,957,716 A 9/1999 Buckley et al.
5,967,852 A 10/1999 Follingstad et al.
5,975,479 A 11/1999 Suter
5,975,591 A 11/1999 Guest

(56) References Cited

U.S. PATENT DOCUMENTS

| | | | |
|---|---|---|---|
| 5,975,949 | A | 11/1999 | Holliday et al. |
| 5,975,951 | A | 11/1999 | Burris et al. |
| 5,977,841 | A | 11/1999 | Lee et al. |
| 5,997,350 | A | 12/1999 | Burris et al. |
| 6,010,349 | A | 1/2000 | Porter, Jr. |
| 6,019,635 | A | 2/2000 | Nelson |
| 6,022,237 | A | 2/2000 | Esh |
| 6,032,358 | A | 3/2000 | Wild |
| 6,036,540 | A | 3/2000 | Beloritsky |
| 6,042,422 | A | 3/2000 | Youtsey |
| 6,048,229 | A | 4/2000 | Lazaro, Jr. |
| 6,053,743 | A | 4/2000 | Mitchell et al. |
| 6,053,769 | A | 4/2000 | Kubota et al. |
| 6,053,777 | A | 4/2000 | Boyle |
| 6,062,607 | A | 5/2000 | Bartholomew |
| 6,080,015 | A | 6/2000 | Andreescu |
| 6,083,053 | A | 7/2000 | Anderson, Jr. et al. |
| 6,089,903 | A | 7/2000 | Stafford Gray et al. |
| 6,089,912 | A | 7/2000 | Tallis et al. |
| 6,089,913 | A | 7/2000 | Holliday |
| 6,093,043 | A | 7/2000 | Gray et al. |
| 6,095,828 | A | 8/2000 | Burland |
| 6,095,841 | A | 8/2000 | Felps |
| 6,123,550 | A | 9/2000 | Burkert et al. |
| 6,123,567 | A | 9/2000 | McCarthy |
| 6,132,234 | A | 10/2000 | Waidner et al. |
| 6,146,197 | A | 11/2000 | Holliday et al. |
| 6,152,752 | A | 11/2000 | Fukuda |
| 6,152,753 | A | 11/2000 | Johnson et al. |
| 6,153,830 | A | 11/2000 | Montena |
| 6,162,995 | A | 12/2000 | Bachle et al. |
| 6,164,977 | A | 12/2000 | Lester |
| 6,174,206 | B1 | 1/2001 | Yentile et al. |
| 6,183,298 | B1 | 2/2001 | Henningsen |
| 6,199,913 | B1 | 3/2001 | Wang |
| 6,199,920 | B1 | 3/2001 | Neustadtl |
| 6,210,216 | B1 | 4/2001 | Tso-Chin et al. |
| 6,210,219 | B1 | 4/2001 | Zhu et al. |
| 6,210,222 | B1 | 4/2001 | Langham et al. |
| 6,217,383 | B1 | 4/2001 | Holland et al. |
| 6,238,240 | B1 | 5/2001 | Yu |
| 6,239,359 | B1 | 5/2001 | Lilienthal, II et al. |
| 6,241,553 | B1 | 6/2001 | Hsia |
| 6,250,974 | B1 | 6/2001 | Kerek |
| 6,257,923 | B1 | 7/2001 | Stone et al. |
| 6,261,126 | B1 | 7/2001 | Stirling |
| 6,267,612 | B1 | 7/2001 | Arcykiewicz et al. |
| 6,271,464 | B1 | 8/2001 | Cunningham |
| 6,331,123 | B1 | 12/2001 | Rodrigues |
| 6,332,815 | B1 | 12/2001 | Bruce |
| 6,352,448 | B1 | 3/2002 | Holliday et al. |
| 6,358,077 | B1 | 3/2002 | Young |
| 6,361,348 | B1 | 3/2002 | Hall et al. |
| 6,361,364 | B1 | 3/2002 | Holland et al. |
| 6,375,509 | B2 | 4/2002 | Mountford |
| 6,394,840 | B1 | 5/2002 | Gassauer et al. |
| 6,396,367 | B1 | 5/2002 | Rosenberger |
| D458,904 | S | 6/2002 | Montena |
| 6,406,330 | B2 | 6/2002 | Bruce |
| 6,409,534 | B1 | 6/2002 | Weisz-Margulescu |
| D460,739 | S | 7/2002 | Fox |
| D460,740 | S | 7/2002 | Montena |
| D460,946 | S | 7/2002 | Montena |
| D460,947 | S | 7/2002 | Montena |
| D460,948 | S | 7/2002 | Montena |
| 6,422,884 | B1 | 7/2002 | Babasick et al. |
| 6,422,900 | B1 | 7/2002 | Hogan |
| 6,425,782 | B1 | 7/2002 | Holland |
| D461,166 | S | 8/2002 | Montena |
| D461,167 | S | 8/2002 | Montena |
| D461,778 | S | 8/2002 | Fox |
| D462,058 | S | 8/2002 | Montena |
| D462,060 | S | 8/2002 | Fox |
| 6,439,899 | B1 | 8/2002 | Muzslay et al. |
| D462,327 | S | 9/2002 | Montena |
| 6,450,829 | B1 | 9/2002 | Weisz-Margulescu |
| 6,454,463 | B1 | 9/2002 | Halbach et al. |
| 6,464,526 | B1 | 10/2002 | Seufert et al. |
| 6,467,816 | B1 | 10/2002 | Huang |
| 6,468,100 | B1 | 10/2002 | Meyer et al. |
| 6,491,546 | B1 | 12/2002 | Perry |
| D468,696 | S | 1/2003 | Montena |
| 6,506,083 | B1 | 1/2003 | Bickford et al. |
| 6,520,800 | B1 | 2/2003 | Michelbach et al. |
| 6,530,807 | B2 | 3/2003 | Rodrigues et al. |
| 6,540,531 | B2 | 4/2003 | Syed et al. |
| 6,558,194 | B2 | 5/2003 | Montena |
| 6,572,419 | B2 | 6/2003 | Feye-Homann |
| 6,576,833 | B2 | 6/2003 | Covaro et al. |
| 6,619,876 | B2 | 9/2003 | Vaitkus et al. |
| 6,634,906 | B1 | 10/2003 | Yeh |
| 6,663,397 | B1 | 12/2003 | Lin et al. |
| 6,676,446 | B2 | 1/2004 | Montena |
| 6,683,253 | B1 | 1/2004 | Lee |
| 6,692,285 | B2 | 2/2004 | Islam |
| 6,692,286 | B1 | 2/2004 | De Cet |
| 6,695,636 | B2 | 2/2004 | Hall et al. |
| 6,705,875 | B2 | 3/2004 | Berghorn et al. |
| 6,705,884 | B1 | 3/2004 | McCarthy |
| 6,709,280 | B1 | 3/2004 | Gretz |
| 6,712,631 | B1 | 3/2004 | Youtsey |
| 6,716,041 | B2 | 4/2004 | Ferderer et al. |
| 6,716,062 | B1 | 4/2004 | Palinkas et al. |
| 6,733,336 | B1 | 5/2004 | Montena et al. |
| 6,733,337 | B2 | 5/2004 | Kodaira |
| 6,752,633 | B2 | 6/2004 | Aizawa et al. |
| 6,761,571 | B2 | 7/2004 | Hida |
| 6,767,248 | B1 | 7/2004 | Hung |
| 6,769,926 | B1 | 8/2004 | Montena |
| 6,780,029 | B1 | 8/2004 | Gretz |
| 6,780,042 | B1 | 8/2004 | Badescu et al. |
| 6,780,052 | B2 | 8/2004 | Montena et al. |
| 6,780,068 | B2 | 8/2004 | Bartholoma et al. |
| 6,783,394 | B1 | 8/2004 | Holliday |
| 6,786,767 | B1 | 9/2004 | Fuks et al. |
| 6,790,081 | B2 | 9/2004 | Burris et al. |
| 6,793,528 | B2 | 9/2004 | Lin et al. |
| 6,802,738 | B1 | 10/2004 | Henningsen |
| 6,805,581 | B2 | 10/2004 | Love |
| 6,805,583 | B2 | 10/2004 | Holliday et al. |
| 6,805,584 | B1 | 10/2004 | Chen |
| 6,808,415 | B1 | 10/2004 | Montena |
| 6,817,272 | B2 | 11/2004 | Holland |
| 6,817,896 | B2 | 11/2004 | Derenthal |
| 6,817,897 | B2 | 11/2004 | Chee |
| 6,827,608 | B2 | 12/2004 | Hall et al. |
| 6,830,479 | B2 | 12/2004 | Holliday |
| 6,848,115 | B2 | 1/2005 | Sugiura et al. |
| 6,848,939 | B2 | 2/2005 | Stirling |
| 6,848,940 | B2 | 2/2005 | Montena |
| 6,848,941 | B2 | 2/2005 | Wlos et al. |
| 6,884,113 | B1 | 4/2005 | Montena |
| 6,884,115 | B2 | 4/2005 | Malloy |
| 6,887,102 | B1 | 5/2005 | Burris et al. |
| 6,929,265 | B2 | 8/2005 | Holland et al. |
| 6,929,508 | B1 | 8/2005 | Holland |
| 6,935,866 | B2 | 8/2005 | Kerekes et al. |
| 6,939,169 | B2 | 9/2005 | Islam et al. |
| 6,942,516 | B2 | 9/2005 | Shimoyama et al. |
| 6,942,520 | B2 | 9/2005 | Barlian et al. |
| 6,945,805 | B1 | 9/2005 | Bollinger |
| 6,948,976 | B2 | 9/2005 | Goodwin et al. |
| 6,953,371 | B2 | 10/2005 | Baker et al. |
| 6,955,563 | B1 | 10/2005 | Croan |
| 6,971,912 | B2 | 12/2005 | Montena et al. |
| 7,008,263 | B2 | 3/2006 | Holland |
| 7,018,216 | B1 | 3/2006 | Clark et al. |
| 7,018,235 | B1 | 3/2006 | Burris et al. |
| 7,029,326 | B2 | 4/2006 | Montena |
| 7,063,565 | B2 | 6/2006 | Ward |
| 7,070,447 | B1 | 7/2006 | Montena |
| 7,077,697 | B2 | 7/2006 | Kooiman |
| 7,086,897 | B2 | 8/2006 | Montena |
| 7,090,525 | B1 | 8/2006 | Morana |

(56) References Cited

U.S. PATENT DOCUMENTS 7,094,114 B2 8/2006 Kurimoto
7,097,499 B1 8/2006 Purdy
7,102,868 B2 9/2006 Montena
7,108,547 B2 9/2006 Kisling et al.
7,112,078 B2 9/2006 Czikora
7,112,093 B1 9/2006 Holland
7,114,990 B2 10/2006 Bence et al. ..... 439/583
7,118,285 B2 10/2006 Fenwick et al.
7,118,382 B2 10/2006 Kerekes et al.
7,118,416 B2 10/2006 Montena et al.
7,125,283 B1 10/2006 Lin
7,128,604 B2 10/2006 Hall
7,131,867 B1 11/2006 Foster et al.
7,131,868 B2 11/2006 Montena
7,140,645 B2 11/2006 Cronley
7,144,271 B1 12/2006 Burris et al.
7,147,509 B1 12/2006 Burris et al.
7,156,696 B1 1/2007 Montena
7,161,785 B2 1/2007 Chawgo
7,165,974 B2 1/2007 Kooiman
7,173,121 B2 2/2007 Fang
7,179,121 B1 2/2007 Burris et al.
7,179,122 B2 2/2007 Holliday
7,182,639 B2 2/2007 Burris
7,189,114 B1 3/2007 Burris et al.
7,192,308 B2 3/2007 Rodrigues et al.
7,229,303 B2 6/2007 Vermoesen et al.
7,238,047 B2 7/2007 Saettele et al.
7,252,536 B2 8/2007 Lazaro, Jr. et al.
7,252,546 B1 8/2007 Holland
7,255,598 B2 8/2007 Montena et al.
7,261,594 B2 8/2007 Kodama et al.
7,264,502 B2 9/2007 Holland
7,278,882 B1 10/2007 Li
7,288,002 B2 10/2007 Rodrigues et al.
7,291,033 B2 11/2007 Hu
7,297,023 B2 11/2007 Chawgo
7,299,550 B2 11/2007 Montena
7,318,609 B2 1/2008 Naito et al.
7,322,846 B2 1/2008 Camelio
7,322,851 B2 1/2008 Brookmire
7,329,139 B2 2/2008 Benham
7,335,058 B1 2/2008 Burris et al.
7,347,129 B1 3/2008 Youtsey
7,347,726 B2 3/2008 Wlos
7,347,727 B2 3/2008 Wlos et al.
7,347,729 B2 3/2008 Thomas et al.
7,351,088 B1 4/2008 Qu
7,357,641 B2 4/2008 Kerekes et al.
7,364,462 B2 4/2008 Holland
7,371,112 B2 5/2008 Burris et al.
7,375,533 B2 5/2008 Gale
7,387,524 B2 6/2008 Cheng
7,393,245 B2 7/2008 Palinkas et al.
7,396,249 B2 7/2008 Kauffman
7,404,737 B1 7/2008 Youtsey
7,410,389 B2 8/2008 Holliday
7,416,415 B2 8/2008 Hart et al.
7,438,327 B2 10/2008 Auray et al.
7,452,239 B2 11/2008 Montena
7,455,550 B1 11/2008 Sykes
7,458,850 B1 12/2008 Burris et al.
7,458,851 B2 12/2008 Montena
7,462,068 B2 12/2008 Amidon
7,467,980 B2 12/2008 Chiu
7,476,127 B1 1/2009 Wei
7,478,475 B2 1/2009 Hall
7,479,033 B1 1/2009 Sykes et al.
7,479,035 B2 1/2009 Bence et al. ..... 439/583
7,484,988 B2 2/2009 Ma et al.
7,484,997 B2 2/2009 Hofling
7,488,210 B1 2/2009 Burris et al.
7,494,355 B2 2/2009 Hughes et al.
7,497,729 B1 3/2009 Wei
7,500,868 B2 3/2009 Holland et al.
7,500,873 B1 3/2009 Hart
7,507,116 B2 3/2009 Laerke et al.
7,507,117 B2 3/2009 Amidon
7,513,788 B2 4/2009 Camelio
7,544,094 B1 6/2009 Paglia et al.
7,563,133 B2 7/2009 Stein
7,566,236 B2 7/2009 Malloy et al.
7,568,945 B2 8/2009 Chee et al.
7,578,693 B2 8/2009 Yoshida et al.
7,588,454 B2 9/2009 Nakata et al.
7,607,942 B1 10/2009 Van Swearingen
7,625,227 B1 12/2009 Henderson et al.
7,632,143 B1 12/2009 Islam
7,635,283 B1 12/2009 Islam
7,651,376 B2 1/2010 Schreier
7,674,132 B1 3/2010 Chen
7,682,177 B2 3/2010 Berthet
7,714,229 B2 5/2010 Burris et al.
7,727,011 B2 6/2010 Montena et al.
7,749,021 B2 7/2010 Brodeur
7,753,705 B2 7/2010 Montena
7,753,710 B2 7/2010 George
7,753,727 B1 7/2010 Islam et al.
7,758,370 B1 7/2010 Flaherty
7,794,275 B2 9/2010 Rodrigues
7,806,714 B2 10/2010 Williams et al.
7,806,725 B1 10/2010 Chen
7,811,133 B2 10/2010 Gray
D626,920 S 11/2010 Purdy et al.
7,824,216 B2 11/2010 Purdy ..... 439/578
7,828,595 B2 11/2010 Mathews
7,830,154 B2 11/2010 Gale
7,833,053 B2 11/2010 Mathews
7,845,976 B2 12/2010 Mathews
7,845,978 B1 12/2010 Chen
7,845,980 B1 12/2010 Amidon
7,850,472 B2 12/2010 Friedrich et al.
7,850,487 B1 12/2010 Wei
7,857,661 B1 12/2010 Islam
7,874,870 B1 1/2011 Chen
7,887,354 B2 2/2011 Holliday
7,892,004 B2 2/2011 Hertzler et al.
7,892,005 B2 2/2011 Haube ..... 439/321
7,892,024 B1 2/2011 Chen
7,914,326 B2 3/2011 Sutter
7,918,687 B2 4/2011 Paynter et al.
7,927,135 B1 4/2011 Wlos
7,934,955 B1 5/2011 Hsia
7,942,695 B1 5/2011 Lu
7,950,958 B2 5/2011 Mathews
7,955,126 B2 6/2011 Bence et al.
7,972,158 B2 7/2011 Wild et al.
7,972,176 B2 7/2011 Burris et al.
7,982,005 B2 7/2011 Ames et al.
8,011,955 B1 9/2011 Lu
8,025,518 B2 9/2011 Burris et al.
8,029,315 B2 10/2011 Purdy et al.
8,029,316 B2 10/2011 Snyder et al.
8,062,044 B2 11/2011 Montena et al.
8,062,063 B2 11/2011 Malloy et al.
8,070,504 B2 12/2011 Amidon et al.
8,075,337 B2 12/2011 Malloy et al.
8,075,338 B1 12/2011 Montena ..... 439/578
8,079,860 B1 12/2011 Zraik
8,087,954 B2 1/2012 Fuchs
8,113,875 B2 2/2012 Malloy et al.
8,113,879 B1 2/2012 Zraik
8,157,587 B2 4/2012 Paynter et al.
8,157,588 B1 4/2012 Rodrigues et al.
8,167,635 B1 5/2012 Mathews
8,167,636 B1 5/2012 Montena
8,172,612 B2 5/2012 Bence et al.
8,177,572 B2 5/2012 Feye-Hohmann
8,192,237 B2 6/2012 Purdy et al. ..... 439/792
8,206,172 B2 6/2012 Katagiri et al.
D662,893 S 7/2012 Haberek et al.
8,231,412 B2 7/2012 Paglia et al.
8,262,408 B1 9/2012 Kelly
8,272,893 B2 9/2012 Burris et al.

(56) References Cited

U.S. PATENT DOCUMENTS 8,287,320 B2 10/2012 Purdy et al.
8,313,345 B2 11/2012 Purdy
8,313,353 B2 11/2012 Purdy et al.
8,317,539 B2 11/2012 Stein
8,323,053 B2 12/2012 Montena
8,323,058 B2 12/2012 Flaherty et al.
8,323,060 B2 12/2012 Purdy et al.
8,337,229 B2 12/2012 Montena
8,366,481 B2 2/2013 Ehret et al.
8,376,769 B2 2/2013 Holland et al.
D678,844 S 3/2013 Haberek
8,398,421 B2 3/2013 Haberek et al.
8,449,326 B2 5/2013 Holland et al.
8,465,322 B2 6/2013 Purdy
8,469,739 B2 6/2013 Rodrigues et al.
8,469,740 B2 6/2013 Ehret et al.
D686,164 S 7/2013 Haberek et al.
D686,576 S 7/2013 Haberek et al.
8,475,205 B2 7/2013 Ehret et al.
8,480,430 B2 * 7/2013 Ehret et al. ..... 439/578
8,480,431 B2 7/2013 Ehret et al.
8,485,845 B2 7/2013 Ehret et al.
8,506,325 B2 8/2013 Malloy et al.
8,517,763 B2 8/2013 Burris et al.
8,517,764 B2 8/2013 Wei et al.
8,529,279 B2 9/2013 Montena
8,550,835 B2 10/2013 Montena
8,568,163 B2 10/2013 Burris et al.
8,568,165 B2 10/2013 Wei et al.
8,591,244 B2 11/2013 Thomas et al.
8,597,050 B2 12/2013 Flaherty et al.
8,636,529 B2 1/2014 Stein
8,636,541 B2 1/2014 Chastain et al.
8,647,136 B2 2/2014 Purdy et al.
8,690,603 B2 4/2014 Bence et al.
8,721,365 B2 5/2014 Holland
8,727,800 B2 5/2014 Holland et al.
8,777,658 B2 7/2014 Holland et al.
8,777,661 B2 7/2014 Holland et al.
8,858,251 B2 * 10/2014 Montena ..... 439/322
8,888,526 B2 * 11/2014 Burris ..... 439/578
8,920,192 B2 12/2014 Montena
9,017,101 B2 4/2015 Ehret et al.
2001/0034143 A1 10/2001 Annequin
2001/0046802 A1 11/2001 Perry et al.
2001/0051448 A1 12/2001 Gonzalez
2002/0013088 A1 1/2002 Rodrigues et al.
2002/0019161 A1 2/2002 Finke et al.
2002/0038720 A1 4/2002 Kai et al.
2002/0146935 A1 10/2002 Wong
2003/0110977 A1 6/2003 Batlaw
2003/0119358 A1 6/2003 Henningsen
2003/0139081 A1 7/2003 Hall et al.
2003/0194890 A1 10/2003 Ferderer et al.
2003/0214370 A1 11/2003 Allison et al.
2003/0224657 A1 12/2003 Malloy
2004/0031144 A1 2/2004 Holland
2004/0077215 A1 4/2004 Palinkas et al.
2004/0102089 A1 5/2004 Chee
2004/0157499 A1 8/2004 Nania et al.
2004/0194585 A1 10/2004 Clark
2004/0209516 A1 10/2004 Burris et al.
2004/0219833 A1 11/2004 Burris et al.
2004/0229504 A1 11/2004 Liu
2005/0042919 A1 2/2005 Montena
2005/0079762 A1 4/2005 Hsia
2005/0159045 A1 7/2005 Huang
2005/0170692 A1 8/2005 Montena
2005/0181652 A1 8/2005 Montena et al.
2005/0181668 A1 8/2005 Montena et al.
2005/0208827 A1 9/2005 Burris et al.
2005/0233636 A1 10/2005 Rodrigues et al.
2006/0014425 A1 1/2006 Montena
2006/0099853 A1 5/2006 Sattele et al.
2006/0110977 A1 5/2006 Matthews
2006/0154519 A1 * 7/2006 Montena ..... 439/578
2006/0166552 A1 7/2006 Bence et al.
2006/0178046 A1 8/2006 Tusini
2006/0194465 A1 8/2006 Czikora
2006/0223355 A1 10/2006 Hirschmann
2006/0246774 A1 11/2006 Buck
2006/0258209 A1 11/2006 Hall
2006/0276079 A1 12/2006 Chen
2007/0004276 A1 1/2007 Stein
2007/0026734 A1 2/2007 Bence et al.
2007/0049113 A1 3/2007 Rodrigues et al.
2007/0054535 A1 3/2007 Hall et al.
2007/0059968 A1 3/2007 Ohtaka et al.
2007/0082533 A1 4/2007 Currier et al.
2007/0087613 A1 4/2007 Schumacher et al.
2007/0123101 A1 5/2007 Palinkas
2007/0155232 A1 7/2007 Burris et al.
2007/0173100 A1 7/2007 Benham
2007/0175027 A1 8/2007 Khemakhem et al.
2007/0232117 A1 10/2007 Singer
2007/0243759 A1 10/2007 Rodrigues et al.
2007/0243762 A1 10/2007 Burke et al.
2007/0287328 A1 12/2007 Hart et al.
2008/0032556 A1 2/2008 Schreier
2008/0102696 A1 5/2008 Montena
2008/0171466 A1 7/2008 Buck et al.
2008/0200066 A1 8/2008 Hofling
2008/0200068 A1 8/2008 Aguirre
2008/0214040 A1 9/2008 Holterhoff et al.
2008/0289470 A1 11/2008 Aston
2009/0029590 A1 1/2009 Sykes et al.
2009/0098770 A1 4/2009 Bence et al.
2009/0104801 A1 4/2009 Silva
2009/0163075 A1 6/2009 Blew et al.
2009/0186505 A1 7/2009 Mathews
2009/0264003 A1 10/2009 Hertzler et al.
2009/0305560 A1 12/2009 Chen
2010/0007441 A1 1/2010 Yagisawa et al.
2010/0022125 A1 1/2010 Burris et al.
2010/0028563 A1 2/2010 Ota
2010/0055978 A1 3/2010 Montena
2010/0080563 A1 4/2010 DiFonzo et al.
2010/0081321 A1 4/2010 Malloy et al.
2010/0081322 A1 4/2010 Malloy et al.
2010/0087071 A1 4/2010 DiFonzo et al.
2010/0105246 A1 4/2010 Burris et al.
2010/0124839 A1 5/2010 Montena
2010/0130060 A1 5/2010 Islam
2010/0178799 A1 7/2010 Lee
2010/0216339 A1 8/2010 Burris et al.
2010/0233901 A1 9/2010 Wild et al.
2010/0233902 A1 9/2010 Youtsey
2010/0233903 A1 9/2010 Islam
2010/0255719 A1 10/2010 Purdy ..... 439/578
2010/0255721 A1 10/2010 Purdy et al.
2010/0279548 A1 11/2010 Montena et al.
2010/0297871 A1 11/2010 Haube ..... 439/489
2010/0297875 A1 11/2010 Purdy et al. ..... 439/578
2010/0304579 A1 12/2010 Kisling
2010/0323541 A1 12/2010 Amidon et al.
2011/0021072 A1 1/2011 Purdy ..... 439/578
2011/0021075 A1 1/2011 Orner et al.
2011/0027039 A1 2/2011 Blair
2011/0039448 A1 2/2011 Stein
2011/0053413 A1 3/2011 Mathews
2011/0074388 A1 3/2011 Bowman
2011/0080158 A1 4/2011 Lawrence et al.
2011/0111623 A1 5/2011 Burris et al.
2011/0111626 A1 * 5/2011 Paglia et al. ..... 439/584
2011/0117774 A1 * 5/2011 Malloy et al. ..... 439/578
2011/0143567 A1 6/2011 Purdy et al. ..... 439/277
2011/0151714 A1 6/2011 Flaherty et al.
2011/0230089 A1 9/2011 Amidon et al. ..... 439/578
2011/0230091 A1 9/2011 Krenceski et al. ..... 439/578
2011/0237123 A1 9/2011 Burris et al.
2011/0237124 A1 9/2011 Flaherty et al.
2011/0250789 A1 10/2011 Burris et al.
2011/0318958 A1 12/2011 Burris et al.
2012/0021642 A1 1/2012 Zraik

(56) References Cited

U.S. PATENT DOCUMENTS

| | | | | |
|---|---|---|---|---|
| 2012/0040537 | A1 | 2/2012 | Burris | |
| 2012/0045933 | A1 | 2/2012 | Youtsey | |
| 2012/0064768 | A1 | 3/2012 | Islam et al. | |
| 2012/0094530 | A1 | 4/2012 | Montena | |
| 2012/0100751 | A1 | 4/2012 | Montena | |
| 2012/0108098 | A1 | 5/2012 | Burris et al. | |
| 2012/0122329 | A1 | 5/2012 | Montena | |
| 2012/0129387 | A1 | 5/2012 | Holland et al. | |
| 2012/0171894 | A1 | 7/2012 | Malloy et al. | |
| 2012/0178289 | A1* | 7/2012 | Holliday | 439/585 |
| 2012/0202378 | A1 | 8/2012 | Krenceski et al. | |
| 2012/0222302 | A1 | 9/2012 | Purdy et al. | |
| 2012/0225581 | A1 | 9/2012 | Amidon et al. | |
| 2012/0315788 | A1 | 12/2012 | Montena | |
| 2013/0065433 | A1 | 3/2013 | Burris | |
| 2013/0072057 | A1 | 3/2013 | Burris | |
| 2013/0178096 | A1 | 7/2013 | Matzen | |
| 2013/0273761 | A1 | 10/2013 | Ehret et al. | |
| 2014/0106612 | A1 | 4/2014 | Burris | |
| 2014/0106613 | A1 | 4/2014 | Burris | |
| 2014/0120766 | A1 | 5/2014 | Meister et al. | |
| 2014/0137393 | A1 | 5/2014 | Chastain et al. | |
| 2014/0148051 | A1 | 5/2014 | Bence et al. | |
| 2014/0154907 | A1 | 6/2014 | Ehret et al. | |
| 2014/0322968 | A1 | 10/2014 | Burris | |

FOREIGN PATENT DOCUMENTS

| | | |
|---|---|---|
| CN | 201149937 | 11/2008 |
| CN | 201178228 | 1/2009 |
| CN | 201904508 | 7/2011 |
| DE | 47931 | 10/1888 |
| DE | 102289 | 7/1897 |
| DE | 1117687 | 11/1961 |
| DE | 2261973 | 6/1974 |
| DE | 3211008 | 10/1983 |
| DE | 9001608.4 | 4/1990 |
| DE | 4439852 | 5/1996 |
| DE | 19957518 | 9/2001 |
| EP | 116157 | 8/1984 |
| EP | 167738 | 1/1986 |
| EP | 72104 | 2/1986 |
| EP | 265276 | 4/1988 |
| EP | 428424 | 5/1991 |
| EP | 1191268 | 3/2002 |
| EP | 1501159 | 1/2005 |
| EP | 1548898 | 6/2005 |
| EP | 1603200 | 12/2005 |
| EP | 1701410 | 9/2006 |
| EP | 2051340 | 4/2009 |
| FR | 2232846 | 1/1975 |
| FR | 2462798 | 2/1981 |
| FR | 2494508 | 5/1982 |
| GB | 589697 | 6/1947 |
| GB | 1087228 | 10/1967 |
| GB | 1270846 | 4/1972 |
| GB | 1332888 | 10/1973 |
| GB | 1401373 | 7/1975 |
| GB | 1421215 | 1/1976 |
| GB | 2019665 | 10/1979 |
| GB | 2079549 | 1/1982 |
| GB | 2252677 | 8/1992 |
| GB | 2264201 | 8/1993 |
| GB | 2331634 | 5/1999 |
| GB | 2448595 | 10/2008 |
| GB | 2450248 | 12/2008 |
| JP | 3280369 | 12/1991 |
| JP | 200215823 | 1/2002 |
| JP | 4503793 | 7/2010 |
| KR | 100622526 | 9/2006 |
| TW | 427044 | 3/2001 |
| WO | 8700351 | 1/1987 |
| WO | 0186756 | 11/2001 |
| WO | 02069457 | 9/2002 |
| WO | 2004013883 | 2/2004 |
| WO | 2006081141 | 8/2006 |
| WO | 2007062845 | 6/2007 |
| WO | 2009066705 | 5/2009 |
| WO | 2010135181 | 11/2010 |
| WO | 2011057033 | 5/2011 |
| WO | 2011128665 | 10/2011 |
| WO | 2011128666 | 10/2011 |
| WO | 2012162431 | 11/2012 |
| WO | 2013126629 | 8/2013 |

OTHER PUBLICATIONS

Office Action dated Oct. 6, 2014 pertaining to U.S. Appl. No. 13/732,679.

Office Action dated Jun. 12, 2014 pertaining to U.S. Appl. No. 13/795,737.

Office Action dated Aug. 25, 2014 pertaining to U.S. Appl. No. 13/605,481.

Election/Restrictions Requirement dated Jul. 31, 2014 pertaining to U.S. Appl. No. 13/652,969.

Office Action dated Aug. 29, 2014 pertaining to U.S. Appl. No. 13/827,522.

Election/Restrictions Requirement dated Jun. 20, 2014 pertaining to U.S. Appl. No. 13/795,780.

Corning Gilbert 2004 OEM Coaxial Products Catalog, Quick Disconnects, 2 pages.

Digicon AVL Connector. ARRIS Group Inc. [online] 3 pages. Retrieved from the Internet: <URL: http://www.arrisi.com/special/digiconAVL.asp.

Society of Cable Telecommunications Engineers, Engineering Committee, Interface Practices Subcommittee; American National Standard; ANSI/SCTE 01 2006; Specification for "F" Port, Female, Outdoor. Published Jan. 2006. 9 pages.

U.S. Reexamination Control No. 90/012,300 filed Jun. 29, 2012, regarding U.S. Pat. No. 8,172,612 filed May 27, 2011 (Bence et al.).

U.S. Reexamination Control No. 90/012,749 filed Dec. 21, 2012, regarding U.S. Pat. No. 7,114,990, filed Jan. 25, 2005 (Bence et al.).

U.S. Reexamination Control No. 90/012,835 filed Apr. 11, 2013, regarding U.S. Pat. No. 8,172,612 filed May 27, 2011 (Bence et al.).

Notice of Allowance (Mail Date Mar. 20, 2012) for U.S. Appl. No. 13/117,843.

Search Report dated Jun. 6, 2014 pertaining to International application No. PCT/US2014/023374.

Search Report dated Apr. 9, 2014 pertaining to International application No. PCT/US2014/015934.

Society of Cable Telecommunications Engineers, Engineering Committee, Interface Practices Subcommittee; American National Standard; ANSI/SCTE 02 2006; "Specification for "F" Port, Female, Indoor". Published Feb. 2006. 9 pages.

PPC, "Next Generation Compression Connectors," pp. 1-6, Retrieved from http://www.tessco.com/yts/partnearnanufacturer list/vendors/ppc/pdf/ppc digital spread.pdf.

Patent Cooperation Treaty, International Search Report for PCT/US2013/070497, Feb. 11, 2014, 3 pgs.

Patent Cooperation Treaty, International Search Report for PCT/US2013/064515, 10 pgs.

Patent Cooperation Treaty, International Search Report for PCT/US2013/064512, Jan. 21, 2014, 11 pgs.

Huber+Suhner AG, RF Connector Guide: Understanding connector technology, 2007, Retrieved from http://www.ie. itcr.ac.cr/marin/lic/e14515/HUBER+SUENER_RF_Connector_Guide.pdf.

Slade, Paul G,. Electrical Contacts: Principles and Applications, 1999, Retrieved from http://books.google.com/books (table of contents only).

U.S. Reexamination Control No. 95/002,400 filed Sep. 15, 2012, regarding U.S. Pat. No. 8,192,237 filed Feb. 23, 2011 (Purdy et al.).

U.S. Reexamination Control No. 90/013,068 filed Nov. 27, 2013, regarding U.S. Pat. No. 6,558,194 filed Jul. 21, 2000 (Montena).

U.S. Reexamination Control No. 90/013,069 filed Nov. 27, 2013, regarding U.S. Pat. No. 6,848,940 filed Jan. 21, 2003 (Montena).

U.S. Inter Partes Review Case No. 2013-00346 filed Jun. 10, 2013, regarding U.S. Pat. No. 8,287,320 filed Dec. 8, 2009, claims 1-8, 10-16, 18-31 (Purdy et al.).

(56) References Cited

OTHER PUBLICATIONS

U.S. Inter Partes Review Case No. 2013-00343 filed Jun. 10, 2013, regarding U.S. Pat. No. 8,313,353 filed Apr. 30, 2012, claims 1-6 (Purdy et al.).
U.S. Inter Partes Review Case No. 2013-00340 filed Jun. 10, 2013, regarding U.S. Pat. No. 8,323,060 filed Jun. 14, claims 1-9 (Purdy et al.).
U.S. Inter Partes Review Case No. 2013-00347 filed Jun. 10, 2013, regarding U.S. Pat. No. 8,287,320 filed Dec. 8, 2009, claims 9, 17, 32 (Purdy et al.).
U.S. Inter Partes Review Case No. 2013-00345 filed Jun. 10, 2013, regarding U.S. Pat. No. 8,313,353 filed Apr. 30, 2012, claims 7-27 (Purdy et al.).
U.S. Inter Partes Review Case No. 2013-00342 filed Jun. 10, 2013, regarding U.S. Pat. No. 8,323,060 filed Jun. 14, 2012, claims 10-25 (Purdy et al.).
U.S. Inter Partes Review Case No. 2014-00441 filed Feb. 18, 2014, regarding U.S. Pat. No. 8,562,366 filed Oct. 15, 2012, claims 31,37, 39, 41, 42, 55 56 (Purdy et al.).
U.S. Inter Partes Review Case No. 2014-00440 filed Feb. 18, 2014, regarding U.S. Pat. No. 8,597,041 filed Oct. 15, 2012, claims 1, 8, 9, 11, 18-26, 29 (Purdy et al.).
Examiner Edwin A. Leon, US Office Action, U.S. Appl. No. 10/997,218; Jul. 31, 2006, pp. 1-10.
The American Society of Mechanical Engineers; "Lock Washers (Inch Series), An American National Standard"; ASME 818.21.1.-1999 (Revision of ASME B18.21.1-1994); Reaffirmed 2005. Published Feb. 11, 2000. 28 pages.
Corning Cabelcon waterproof CX3 7.0 QuickMount for RG6 cables; Cabelcon Connectors; www.cabelcom.dk; Mar. 15, 2012.
Maury Jr., M.; Microwave Coaxial Connector Technology: a Continuaing Evolution; Maury Microwave Corporation; Dec. 13, 2005; pp. 1-21; Maury Microwave Inc.
"Snap-On/Push-On" SMA Adapter; RF TEC Mfg., Inc.; Mar. 23, 2006; 2 pgs.
RG6 quick mount data sheet; Corning Cabelcon; 2010; 1 pg.; Corning Cabelcon ApS.
RG11 quick mount data sheet; Corning Cabelcon; 2013; 1 pg.; Corning Cabelcon ApS.
Gilbert Engineering Co., Inc.; OEM Coaxial Connectors catalog; Aug. 1993; p. 26.
UltraEase Compression Connectors; "F" Series 59 and 6 Connectors Product Information; May 2005; 4 pgs.
Pomona Electronics Full Line Catelog; vol. 50; 2003; pp. 1-100.
Notice of Allowance dated Feb. 2, 2015 pertaining to U.S. Appl. No. 13/795,737.
Office Action dated Feb. 25, 2015 pertaining to U.S. Appl. No. 13/605,481.
Office Action dated Feb. 18, 2015 pertaining to U.S. Appl. No. 13/827,522.
Office Action dated Mar. 19, 2015 pertaining to U.S. Appl. No. 13/795,780.
Office Action dated Dec. 31, 2014 pertaining to U.S. Appl. No. 13/605,498.
Office Action dated Dec. 16, 2014 pertaining to U.S. Appl. No. 13/653,095.
Office Action dated Dec. 19, 2014 pertaining to U.S. Appl. No. 13/652,969.
Office Action dated Jun. 24, 2015 pertaining to U.S. Appl. No. 13/652,969.

* cited by examiner

COAXIAL CABLE CONNECTOR WITH INTEGRAL RFI PROTECTION

BACKGROUND

1. Field of the Disclosure

The technology of the disclosure relates to coaxial cable connectors and, in particular, to a coaxial cable connector that provides radio frequency interference (RFI) protection and grounding shield.

2. Technical Background

Coaxial cable connectors, such as type F connectors, are used to attach coaxial cable to another object or appliance, e.g., a television set, DVD player, modem or other electronic communication device having a terminal adapted to engage the connector. The terminal of the appliance includes an inner conductor and a surrounding outer conductor.

Coaxial cable includes a center conductor for transmitting a signal. The center conductor is surrounded by a dielectric material, and the dielectric material is surrounded by an outer conductor; this outer conductor may be in the form of a conductive foil and/or braided sheath. The outer conductor is typically maintained at ground potential to shield the signal transmitted by the center conductor from stray noise, and to maintain continuous desired impedance over the signal path. The outer conductor is usually surrounded by a plastic cable jacket that electrically insulates, and mechanically protects, the outer conductor. Prior to installing a coaxial connector onto an end of the coaxial cable, the end of the coaxial cable is typically prepared by stripping off the end portion of the jacket to expose the end portion of the outer conductor. Similarly, it is common to strip off a portion of the dielectric to expose the end portion of the center conductor.

Coaxial cable connectors of the type known in the trade as "F connectors" often include a tubular post designed to slide over the dielectric material, and under the outer conductor of the coaxial cable, at the prepared end of the coaxial cable. If the outer conductor of the cable includes a braided sheath, then the exposed braided sheath is usually folded back over the cable jacket. The cable jacket and folded-back outer conductor extend generally around the outside of the tubular post and are typically received in an outer body of the connector; this outer body of the connector is often fixedly secured to the tubular post. A coupler is typically rotatably secured around the tubular post and includes an internally-threaded region for engaging external threads formed on the outer conductor of the appliance terminal.

When connecting the end of a coaxial cable to a terminal of a television set, equipment box, modem, computer or other appliance, it is important to achieve a reliable electrical connection between the outer conductor of the coaxial cable and the outer conductor of the appliance terminal. Typically, this goal is usually achieved by ensuring that the coupler of the connector is fully tightened over the connection port of the appliance. When fully tightened, the head of the tubular post of the connector directly engages the edge of the outer conductor of the appliance port, thereby making a direct electrical ground connection between the outer conductor of the appliance port and the tubular post; in turn, the tubular post is engaged with the outer conductor of the coaxial cable.

With the increased use of self-install kits provided to home owners by some CATV system operators has come a rise in customer complaints due to poor picture quality in video systems and/or poor data performance in computer/internet systems. Additionally, CATV system operators have found upstream data problems induced by entrance of unwanted radio frequency ("RF") signals into their systems. Complaints of this nature result in CATV system operators having to send a technician to address the issue. Often times it is reported by the technician that the cause of the problem is due to a loose F connector fitting, sometimes as a result of inadequate installation of the self-install kit by the homeowner. An improperly installed or loose connector may result in poor signal transfer because there are discontinuities along the electrical path between the devices, resulting in ingress of undesired RF signals where RF energy from an external source or sources may enter the connector/cable arrangement causing a signal to noise ratio problem resulting in an unacceptable picture or data performance. In particular, RF signals may enter CATV systems from wireless devices, such as cell phones, computers and the like, especially in the 700-800 MHz transmitting range, resulting in radio frequency interference (RFI).

Many of the current state of the art F connectors rely on intimate contact between the F male connector interface and the F female connector interface. If, for some reason, the connector interfaces are allowed to pull apart from each other, such as in the case of a loose F male coupler, an interface "gap" may result. If not otherwise protected this gap can be a point of RF ingress as previously described.

A shield that completely surrounds or encloses a structure or device to protect it against RFI is typically referred to as a "Faraday cage." However, providing such RFI shielding within given structures is complicated when the structure or device comprises moving parts, such as seen in a coaxial connector. Accordingly, creating a connector to act in a manner similar to a Faraday cage to prevent ingress and egress of RF signals can be especially challenging due to the necessary relative movement between connector components required to couple the connector to a related port. Relative movement of components due to mechanical clearances between the components can result in an ingress or egress path for unwanted RF signals and, further, can disrupt the electrical and mechanical communication between components necessary to provide a reliable ground path. The effort to shield and electrically ground a coaxial connector is further complicated when the connector is required to perform when improperly installed, i.e. not tightened to a corresponding port.

U.S. Pat. No. 5,761,053 to, teaches that "[e]lectromagnetic interference (EMI) has been defined as undesired conducted or radiated electrical disturbances from an electrical or electronic apparatus, including transients, which can interfere with the operation of other electrical or electronic apparatus. Such disturbances can occur anywhere in the electromagnetic spectrum. RFI is often used interchangeably with electromagnetic interference, although it is more properly restricted to the radio frequency portion of the electromagnetic spectrum, usually defined as between 24 kilohertz (kHz) and 240 gigahertz (GHz). A shield is defined as a metallic or otherwise electrically conductive configuration inserted between a source of EMI/RFI and a desired area of protection. Such a shield may be provided to prevent electromagnetic energy from radiating from a source. Additionally, such a shield may prevent external electromagnetic energy from entering the shielded system. As a practical matter, such shields normally take the form of an electrically conductive housing which is electrically grounded. The energy of the EMI/RFI is thereby dissipated harmlessly to ground. Because EMI/RFI disrupts the operation of electronic components, such as integrated circuit (IC) chips, IC packages, hybrid components, and multi-chip modules, various methods have been used to contain EMI/RFI from electronic components. The most common method is to electrically ground a "can" that will cover the electronic components, to a substrate such as a printed wiring board. As is well known, a can is a shield that may be in the form of a conductive housing, a metallized cover, a small metal box, a perforated conductive case wherein spaces are arranged to minimize radiation over a given frequency band, or any other form of a conductive surface that surrounds electronic components. When the can is mounted on a substrate such that it completely surrounds and encloses the electronic components, it is often referred to as a Faraday Cage. Presently, there are two predominant methods to form a Faraday cage around electronic components for shielding use. A first method is to solder a can to a ground strip that surrounds electronic components on a printed wiring board (PWB). Although soldering a can provides excellent electrical properties, this method is often labor intensive. Also, a soldered can is difficult to remove if an electronic component needs to be re-worked. A second method is to mechanically secure a can, or other enclosure, with a suitable mechanical fastener, such as a plurality of screws or a clamp, for example. Typically, a conductive gasket material is usually attached to the bottom surface of a can to ensure good electrical contact with the ground strip on the PWB. Mechanically securing a can facilitates the re-work of electronic components; however, mechanical fasteners are bulky and occupy "valuable" space on a PWB."

Coaxial cable connectors have attempted to address the above problems by incorporating a continuity member into the coaxial cable connector as a separate component. In this regard, FIG. 1 illustrates a connector 1000 having a coupler 2000, a separate post '0, a separate continuity member 4000, and a body 5000. In connector 1000 the separate continuity member 4000 is captured between post 3000 and body 5000 and contacts at least a portion of coupler 2000. Coupler 2000 may be made of metal such as brass and plated with a conductive material such as nickel. Post 3000 may be made of metal such as brass and plated with a conductive material such as tin. Separate conductive member 4000 may be made of metal such as phosphor bronze and plated with a conductive material such as tin. Body 5000 may be made of metal such as brass and plated with a conductive material such as nickel.

SUMMARY

Embodiments disclosed herein include a coaxial cable connector having an inner conductor, a dielectric surrounding the inner conductor, an outer conductor surrounding the dielectric, and a jacket surrounding the outer conductor and used for coupling an end of a coaxial cable to an equipment connection port. The coaxial cable may include a coupler, a body, a post, and a retainer. The coupler may be adapted to couple the coaxial cable connector to the equipment connection port. Electrical continuity may be established through the coupler and the post, the retainer and, optionally, the body other than by the use of a component unattached from or independent of the coupler, the post, and the body, to provide RF shielding such that the integrity of an electrical signal transmitted through coaxial cable connector is maintained regardless of the tightness of the coupling of the connector to the terminal. Spurious RF signals are attenuated by at least about 50 dB in a range up to about 1000 MHz. A transfer impedance measured averages about 0.24 ohms. The integrity of an electrical signal transmitted through coaxial cable connector is maintained regardless of the tightness of the coupling of the connector to the equipment connection port.

The coupler may have a threaded portion adapted to connect with a threaded portion of the equipment connection port. At least one thread on the coupler may have a pitch angle different than a pitch angle of at least one thread of the equipment connection port. The pitch angle of the thread of the coupler may be about 2 degrees different than the pitch angle of the thread of the equipment connection port. The pitch angle of the thread of the coupler may be about 62 degrees, and the pitch angle of the thread of the equipment connection port may be about 60 degrees. The threaded portion of the coupler and the threaded portion of the equipment connection port may establish a second circuitous path, and the second circuitous path may attenuate RF signals external to the connector.

In yet another aspect, embodiments disclosed herein include a coaxial cable connector having an inner conductor, a dielectric surrounding the inner conductor, an outer conductor surrounding the dielectric, and a jacket surrounding the outer conductor and used for coupling an end of a coaxial cable to an equipment connection port. The coaxial cable comprises a coupler, a body, a post, and a retainer. The post or the retainer comprises an integral contacting portion. The contacting portion is monolithic with at least a portion of the post or the retainer. When assembled the coupler and post or retainer provide at least one circuitous path resulting in RF shielding such that spurious RF signals are attenuated, such that the integrity of an electrical signal transmitted through coaxial cable connector is maintained regardless of the tightness of the coupling of the connector to the terminal.

RF signals include at least one of RF signals that ingress into the connector and RF signals that egress out from the connector. RF signals are attenuated by at least about 50 dB in a range up to about 1000 MHz and a transfer impedance averages about 0.24 ohms. The at least one circuitous path comprises a first circuitous path and a second circuitous path. The coupler comprises a lip and a step, and the post or the retainer comprises a flange and a shoulder. The first circuitous path is established by at least one of the step, the lip, the flange, the contacting portion and the shoulder. The terminal comprises an equipment connection port, and the coupler comprises a threaded portion adapted to connect with a threaded portion of the equipment connection port, and the threaded portion of the coupler and the threaded portion of the equipment connection port establish a second circuitous path. At least one thread on the coupler has a pitch angle different than a pitch angle of at least one thread of the equipment connection port.

In yet another aspect, embodiments disclosed herein include a coaxial cable connector having an inner conductor, a dielectric surrounding the inner conductor, an outer conductor surrounding the dielectric, and a jacket surrounding the outer conductor and used for coupling an end of a coaxial cable to an equipment connection port. The coaxial cable comprises a coupler, a body, a post and a retainer. The coupler is adapted to couple the connector to the equipment connection port. The coupler has a step and a threaded portion adapted to connect with a threaded portion of the equipment connection port. At least one thread on the coupler has a pitch angle different than a pitch angle of at least one thread of the equipment connection port. The body is assembled with the coupler. The post is assembled with the coupler and the body and is adapted to receive an end of a coaxial cable. The post comprises a flange, a contacting portion and a shoulder.

A first circuitous path is established by the step, the flange, the contacting portion and the shoulder. A second circuitous path is established by the threaded portion of the coupler and the threaded portion of the equipment connection port. The first circuitous path and the second circuitous path provide for RF shielding of the assembled coaxial cable connector wherein RF signals external to the coaxial cable connector are attenuated by at least about 50 dB in a range up to about 1000 MHz, and the integrity of an electrical signal transmitted through coaxial cable connector is maintained regardless of the tightness of the coupling of the connector to the equipment connection port. A transfer impedance averages about 0.24 ohms. Additionally, the pitch angle of the thread of the coupler may be about 2 degrees different than the pitch angle of the thread of the equipment connection port. As a non-limiting example, the pitch angle of the thread of the coupler may be about 62 degrees, and the pitch angle of the thread of the equipment connection port is about 60 degrees.

Additional features and advantages are set out in the detailed description which follows, and in part will be readily apparent to those skilled in the art from that description or recognized by practicing the embodiments as described herein, including the detailed description, the claims, as well as the appended drawings.

It is to be understood that both the foregoing general description and the following detailed description are merely exemplary, and are intended to provide an overview or framework to understanding the nature and character of the claims. The accompanying drawings are included to provide a further understanding, and are incorporated in and constitute a part of this specification. The drawings illustrate one or more embodiment(s), and together with the description serve to explain principles and operation of the various embodiments.

DETAILED DESCRIPTION

Figure 1:
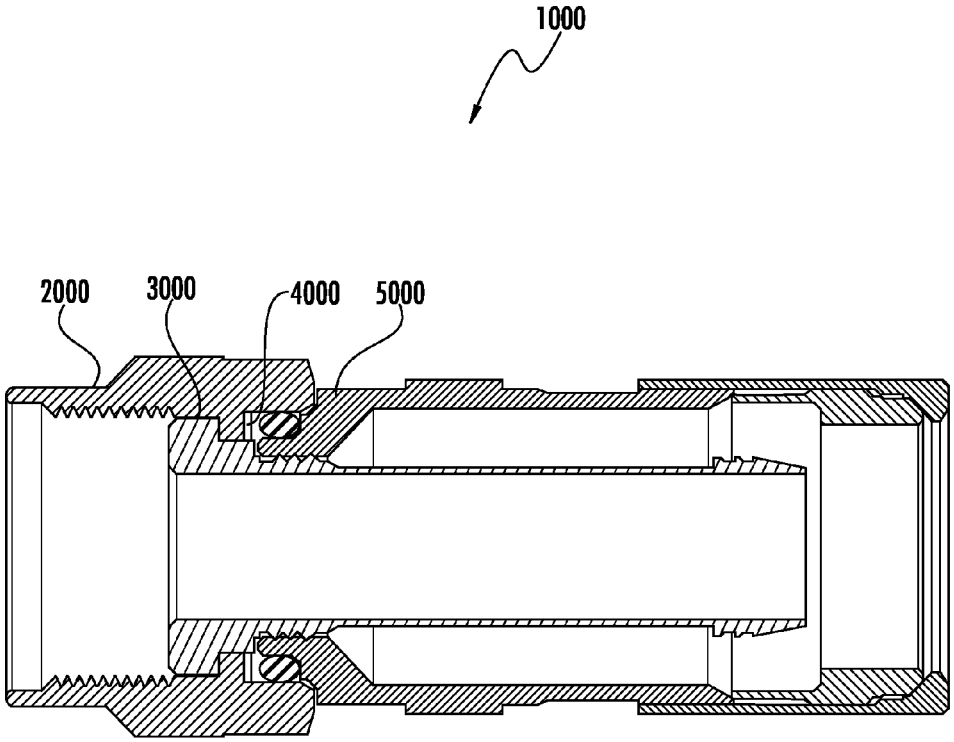
FIG. 1 (PRIOR ART)
FIG. 1 is a side cross sectional view of a coaxial cable connector in the prior art.

Reference will now be made in detail to the embodiments, examples of which are illustrated in the accompanying drawings, in which some, but not all embodiments are shown. Indeed, the concepts may be embodied in many different forms and should not be construed as limiting herein. Rather, these embodiments are provided so that this disclosure will satisfy applicable legal requirements. Whenever possible, like reference numbers will be used to refer to like components or parts.

Coaxial cable connectors are used to couple a prepared end of a coaxial cable to a threaded female equipment connection port of an appliance. The coaxial cable connector may have a post, a moveable post or be postless. In each case, though, in addition to providing an electrical and mechanical connection between the conductor of the coaxial connector and the conductor of the female equipment connection port, the coaxial cable connector provides a ground path from an outer conductor of the coaxial cable to the equipment connection port. The outer conductor may be, as examples, a conductive foil or a braided sheath. To provide RF shielding, electrical continuity may be established through the components of the coaxial connector other than by using a separate grounding or continuity member or component. In other words, electrical continuity may be established other than by using a component unattached from or independent of the other components, which other components may include, but not be limited to, a coupler, a post, a retainer and a body. In this way, the number of components in the coaxial cable connector may be reduced, manufacture simplified, and performance increased.

Maintaining electrical continuity and, thereby, a stable ground path, protects against the ingress of undesired or spurious radio frequency ("RF") signals which may degrade performance of the appliance. In such a way, the integrity of the electrical signal transmitted through coaxial cable connector may be maintained. This is especially applicable when the coaxial cable connector is not fully tightened to the equipment connection port, either due to not being tightened upon initial installation or due to becoming loose after installation.

RF shielding within given structures may be complicated when the structure or device comprises moving parts, such as a coaxial cable connector. Providing a coaxial cable connector that acts as a Faraday cage to prevent ingress and egress of RF signals can be especially challenging due to the necessary relative movement between connector components required to couple the connector to an equipment port. Relative movement of components due to mechanical clearances between the components can result in an ingress or egress path for unwanted RF signal and, further, can disrupt the electrical and mechanical communication between components necessary to provide a reliable ground path. To overcome this situation the coaxial cable connector may incorporate one or more circuitous paths that allow necessary relative movement between connector components and still inhibit ingress or egress of RF signal. This path combined with an integral grounding flange of a component that moveably contacts a coupler acts as a rotatable or moveable Faraday cage within the limited space of a RF coaxial connector creating a connector that both shields against RFI and provides electrical ground even when improperly installed.

Embodiments disclosed herein include a coaxial cable connector having an inner conductor, a dielectric surrounding the inner conductor, an outer conductor surrounding the dielectric, and a jacket surrounding the outer conductor and used for coupling an end of a coaxial cable to an equipment connection port. The coaxial cable comprises a coupler, a body a post, and, optionally, a retainer. The coupler is adapted to couple the connector to the equipment connection port. The coupler has a step and a threaded portion adapted to connect with a threaded portion of the equipment connection port. At least one thread on the coupler has a pitch angle different than a pitch angle of at least one thread of the equipment connection port. The body is assembled with the coupler. The post is assembled with the coupler and the body and is adapted to receive an end of a coaxial cable. The post or the retainer may include a flange, a contacting portion and a shoulder. The contacting portion is integral and monolithic with at least a portion of the post or retainer.

A first circuitous path is established by the step, the flange, the contacting portion and the shoulder. A second circuitous path is established by the threaded portion of the coupler and the threaded portion of the equipment connection port. The first circuitous path and the second circuitous path provide for RF shielding of the assembled coaxial cable connector wherein RF signals external to the coaxial cable connector are attenuated by at least about 50 dB in a range up to about 1000 MHz, and the integrity of an electrical signal transmitted through coaxial cable connector is maintained regardless of the tightness of the coupling of the connector to the equipment connection port. A transfer impedance averages about 0.24 ohms. Additionally, the pitch angle of the thread of the coupler may be about 2 degrees different than the pitch angle of the thread of the equipment connection port. As a non-limiting example, the pitch angle of the thread of the coupler may be about 62 degrees, and the pitch angle of the thread of the equipment connection port is about 60 degrees.

For purposes of this description, the term "forward" will be used to refer to a direction toward the portion of the coaxial cable connector that attaches to a terminal, such as an appliance equipment port. The term "rearward" will be used to refer to a direction that is toward the portion of the coaxial cable connector that receives the coaxial cable. The term "terminal" will be used to refer to any type of connection medium to which the coaxial cable connector may be coupled, as examples, an appliance equipment port, any other type of connection port, or an intermediate termination device. Further, it should be understood that the term "RF shield" or "RF shielding" shall be used herein to also refer to radio frequency interference (RFI) shield or shielding and electromagnetic interference (EMI) shield or shielding, and such terms should be considered as synonymous. Additionally, for purposes herein, electrical continuity shall mean DC contact resistance from the outer conductor of the coaxial cable to the equipment port of less than about 3000 milliohms. Accordingly, a DC contact resistance of more than about 3000 milliohms shall be considered as indicating electrical discontinuity or an open in the path between the outer conductor of the coaxial cable and the equipment port.

Figure 2:
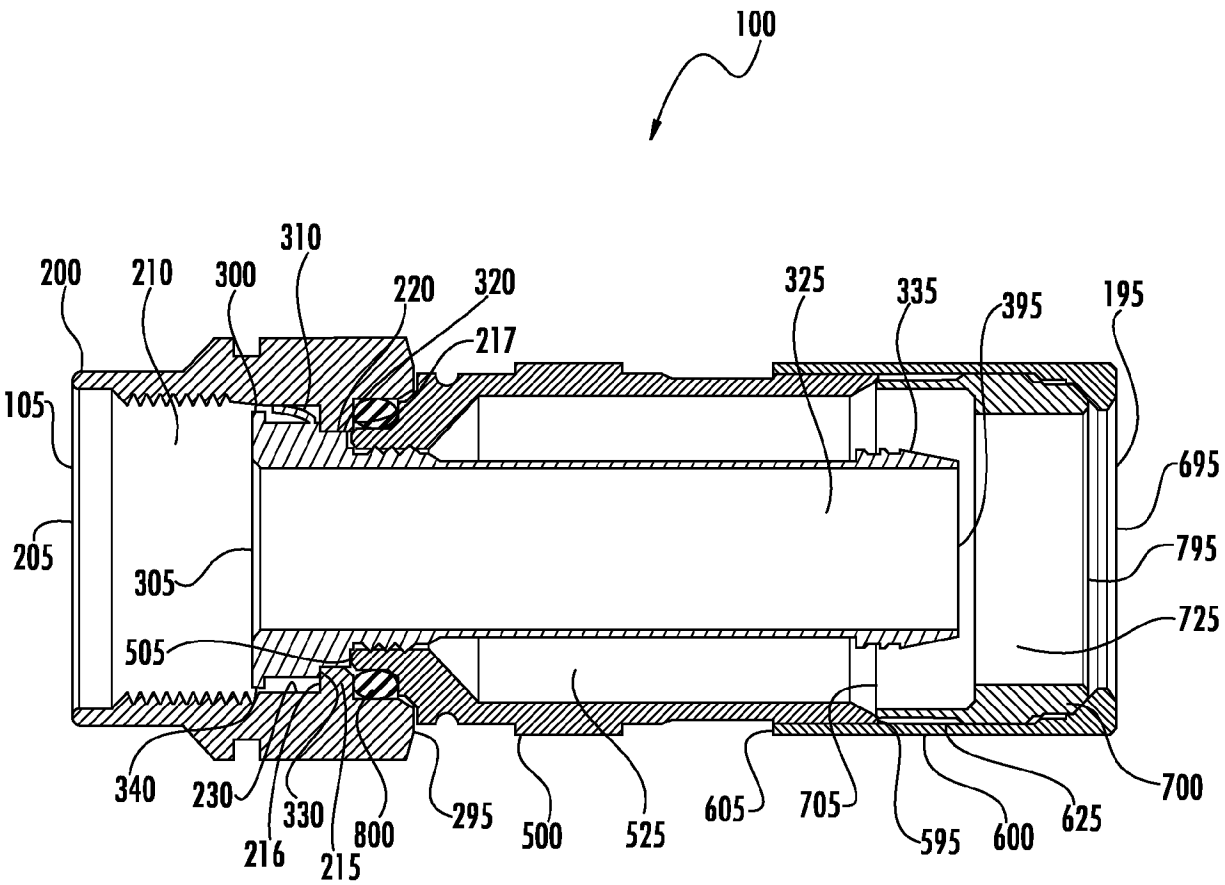
FIG. 2 is a side, cross sectional view of an exemplary embodiment of a coaxial connector comprising a post with a contacting portion providing an integral RFI and grounding shield.

Referring now to FIG. 2, there is illustrated an exemplary embodiment of a coaxial cable connector 100. The coaxial cable connector 100 has a front end 105, a back end 195, a coupler 200, a post 300, a body 500, a shell 600 and a gripping member 700. The coupler 200 comprises a front end 205, a back end 295, a central passage 210, a lip 215 with a forward facing surface 216 and a rearward facing surface 217, a through-bore 220 formed by the lip 215, and a bore 230. Coupler 200 may be made of metal such as brass and plated with a conductive material such as nickel. Alternately or additionally, selected surfaces of the coupler 200 may be coated with conductive or non-conductive coatings or lubricants, or a combination thereof. Post 300 may be tubular and include a front end 305, a back end 395, and a contacting portion 310. In FIG. 2, contacting portion 310 is shown as a protrusion integrally formed and monolithic with post 300. Contacting portion 310 may, but does not have to be, radially projecting. Post 300 may also comprise an enlarged shoulder 340, a flange 320, a through-bore 325, a rearward facing annular surface 330, and a barbed portion 335 proximate the back end 395. The post 300 may be made of metal such as brass and plated with a conductive material such as tin. Additionally, the material, in an exemplary embodiment, may have a suitable spring characteristic permitting contacting portion 310 to be flexible, as described below. Alternately or additionally, selected surfaces of post 300 may be coated with conductive or non-conductive coatings or lubricants or a combination thereof. Contacting portion 310, as noted above, is monolithic with post 300 and provides for electrical continuity through the connector 100 to an equipment port (not shown in FIG. 2) to which connector 100 may be coupled. In this manner, post 300 provides for a stable ground path through the connector 100, and, thereby, electromagnetic or RF shielding to protect against the ingress and egress of RF signals. Electrical continuity is established through the coupler 200, the post 300, and the body other than by the use of a component unattached from or independent of the coupler 200, the post 300, and the body 500, to provide RF shielding. In this way, the integrity of an electrical signal transmitted through coaxial cable connector 100 may be maintained regardless of the tightness of the coupling of the connector 100 to the terminal. Maintaining electrical continuity and, thereby, a stable ground path, protects against the ingress of undesired or spurious radio frequency ("RF") signals which may degrade performance of the appliance. In such a way, the integrity of the electrical signal transmitted through coaxial cable connector 100 may be maintained. This is especially applicable when the coaxial cable connector 100 is not fully tightened to the equipment connection port, either due to not being tightened upon initial installation or due to becoming loose after installation.

Body 500 comprises a front end 505, a back end 595, and a central passage 525. Body 500 may be made of metal such as brass and plated with a conductive material such as nickel. Shell 600 comprises a front end 605, a back end 695, and a central passage 625. Shell 600 may be made of metal such as brass and plated with a conductive material such as nickel. Gripping member 700 comprises a front end 705, a back end 795, and a central passage 725. Gripping member 700 may be made of a suitable polymer material such as acetal or nylon. The resin can be selected from thermoplastics characterized by good fatigue life, low moisture sensitivity, high resistance to solvents and chemicals, and good electrical properties.

In FIG. 2, coaxial cable connector 100 is shown in an unattached, uncompressed state, without a coaxial cable inserted therein. Coaxial cable connector 100 couples a prepared end of a coaxial cable to a terminal, such as a threaded female equipment appliance connection port (not shown in FIG. 2). This will be discussed in more detail with reference to FIG. 18A. Shell 600 slideably attaches to body 500 at back end 595 of body 500. Coupler 200 attaches to coaxial cable connector 100 at back end 295 of coupler 200. Coupler 200 may rotatably attach to front end 305 of post 300 while engaging body 500 by means of a press-fit. Front end 305 of post 300 positions in central passage 210 of coupler 200 and has a back end 395 which is adapted to extend into a coaxial cable. Proximate back end 395, post 300 has a barbed portion 335 extending radially outwardly from post 300. An enlarged shoulder 340 at front end 305 extends inside the coupler 200. Enlarged shoulder 340 comprises a collar portion 320 and a rearward facing annular surface 330. Collar portion 320 allows coupler 200 to rotate by means of a clearance fit with through-bore 220 of coupler 200. Rearward facing annular surface 330 limits forward axial movement of the coupler 200 by engaging forward facing surface 216 of lip 215. Coaxial cable connector 100 may also include a sealing ring 800 seated within coupler 200 to form a seal between coupler 200 and body 500.

Contacting portion 310 may be monolithic with or a unitized portion of post 300. As such, contacting portion 310 and post 300 or a portion of post 300 may be constructed from a single piece of material. The contacting portion 310 may contact coupler 200 at a position that is forward of forward facing surface 216 of lip 215. In this way, contacting portion 310 of post 300 provides an electrically conductive path between post 300, coupler 200 and body 500. This enables an electrically conductive path from coaxial cable through coaxial cable connector 100 to terminal providing an electrical ground and a shield against RF ingress and egress. Contacting portion 310 is formable such that as the coaxial cable connector 100 is assembled, contacting portion 310 may form to a contour of coupler 200. In other words, coupler 200 forms or shapes contacting portion 310 of post 300. The forming and shaping of the contacting portion 310 may have certain elastic/plastic properties based on the material of contacting portion 310. Contacting portion 310 deforms, upon assembly of the components of coaxial cable connector 100, or, alternatively contacting portion 310 of post 300 may be preformed, or partially preformed to electrically contactedly fit with coupler 200 as explained in greater detail with reference to FIG. 4A through FIG. 4D, below. In this manner, post 300 is secured within coaxial cable connector 100, and contacting portion 310 establishes an electrically conductive path between body 500 and coupler 200. Further, the electrically conductive path remains established regardless of the tightness of the coaxial cable connector 100 on the terminal due to the elastic/plastic properties of contacting portion 310. This is due to contacting portion 310 maintaining mechanical and electrical contact between components, in this case, post 300 and coupler 200, notwithstanding the size of any interstice between the components of the coaxial cable connector 100. In other words, contacting portion 310 is integral to and maintains the electrically conductive path established between post 300 and coupler 200 even when the coaxial cable connector 100 is loosened and/or partially disconnected from the terminal, provided there is some contact of coupler 200 with equipment port.

Although coaxial connector 100 in FIG. 2 is an axial-compression type coaxial connector having a post 300, contacting portion 310 may be integral to and monolithic with any type of coaxial cable connector and any other component of a coaxial cable connector, examples of which will be discussed herein with reference to the embodiments. However, in all such exemplary embodiments, contacting portion 310 provides for electrical continuity from an outer conductor of a coaxial cable received by coaxial cable connector 100 through coaxial cable connector 100 to a terminal, without the need for a separate component. Additionally, the contacting portion 310 provides for electrical continuity regardless of how tight or loose the coupler is to the terminal. In other words, contacting portion 310 provides for electrical continuity from the outer conductor of the coaxial cable to the terminal regardless and/or irrespective of the tightness or adequacy of the coupling of the coaxial cable connector 100 to the terminal. It is only necessary that the coupler 200 be in contact with the terminal.

Figure 3A:
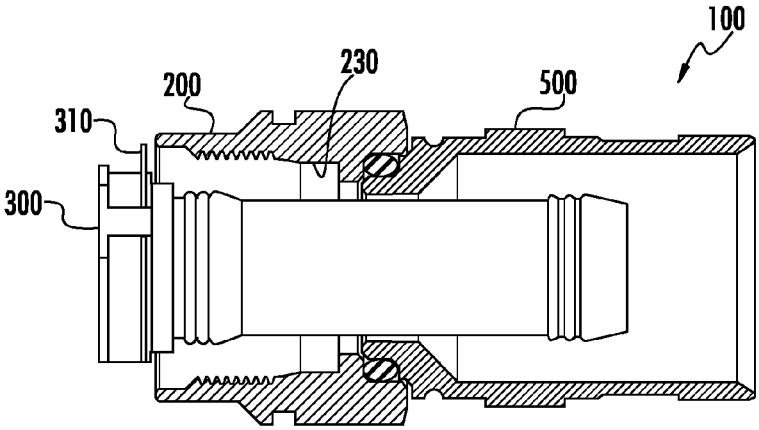
FIG. 3A is side, cross-sectional view of the coaxial cable connector of FIG. 2 in a state of partial assembly.
Figure 3B:
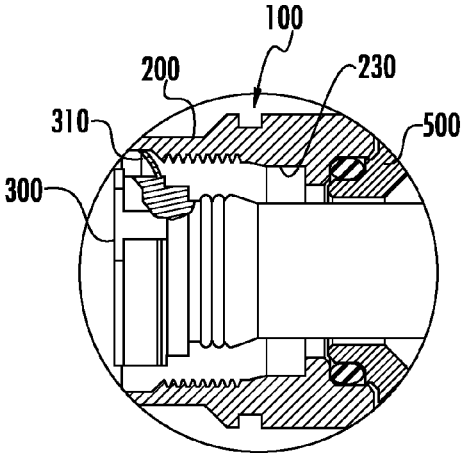
FIG. 3B is a partial, cross-sectional detail view of the post of the coaxial cable connector of FIG. 2 in a state of further assembly than as illustrated in FIG. 3A, and illustrating the contacting portion of the post beginning to form to a contour of the coupler.
Figure 3C:
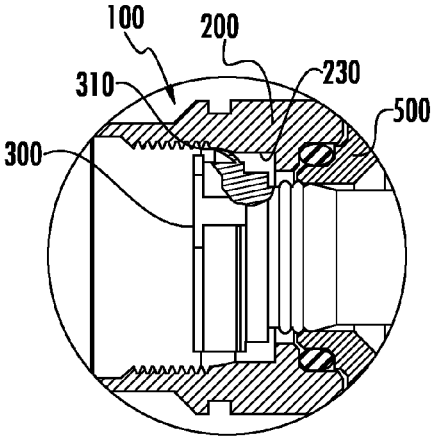
FIG. 3C is a partial, cross-sectional detail view of the post of the coaxial cable connector of FIG. 2 in a state of further assembly than as illustrated in FIGS. 3A and 3B, and illustrating the contacting portion of the post continuing to form to a contour of the coupler.
Figure 3D:
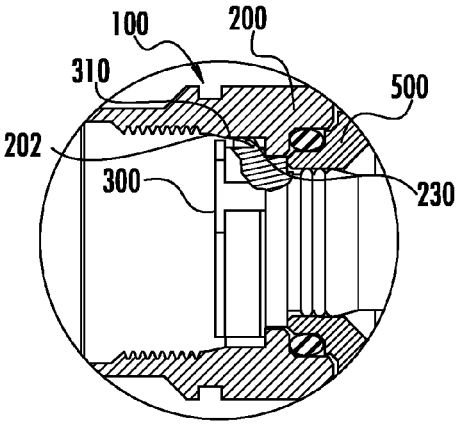
FIG. 3D is a partial, cross-sectional detail view of the post of the coaxial cable connector of FIG. 2 in a state of further assembly than as illustrated in FIGS. 3A, 3B and 3C and illustrating the contacting portion of the post forming to a contour of the coupler.

Referring now to FIGS. 3A, 3B 3C and 3D, post 300 is illustrated in different states of assembly with coupler 200 and body 500. In FIG. 3A, post 300 is illustrated partially assembled with coupler 200 and body 500 with contacting portion 310 of post 300, shown as a protrusion, outside and forward of coupler 200. Contacting portion 310 may, but does not have to be, radially projecting. In FIG. 3B, contacting portion 310 has begun to advance into coupler 200 and contacting portion 310 is beginning to form to a contour of coupler 200. As illustrated in FIG. 3B, contacting portion 310 is forming to an arcuate or, at least, a partially arcuate shape. As post 300 is further advanced into coupler 200 as shown in FIG. 3C, contacting portion 310 continues to form to the contour of coupler 200. When assembled as shown in FIG. 3D, contacting portion 310 is forming to the contour of coupler 200 and is contactedly engaged with bore 230 accommodating tolerance variations with bore 230. In FIG. 3D coupler 200 has a face portion 202 that tapers. The face portion 202 guides the contacting portion 310 to its formed state during assembly in a manner that does not compromise its structural integrity, and, thereby, its elastic/plastic property. Face portion 202 may be or have other structural features, as a non-limiting example, a curved edge, to guide the contacting portion 310. The flexible or resilient nature of the contacting portion 310 in the formed state as described above permits coupler 200 to be easily rotated and yet maintain a reliable electrically conductive path. It should be understood, that contacting portion 310 is formable and, as such, may exist in an unformed and a formed state based on the elastic/plastic property of the material of contacting portion 310. As the coaxial cable connector 100 assembles contacting portion 310 transitions from an unformed state to a formed state.

Figure 4A:
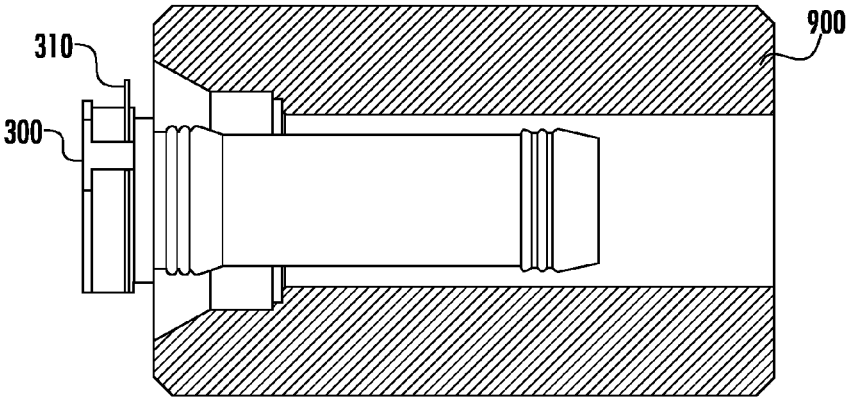
FIG. 4A is a partial, cross-sectional view of the post of the coaxial cable connector of FIG. 2 in which the post is partially inserted into a forming tool.
Figure 4B:
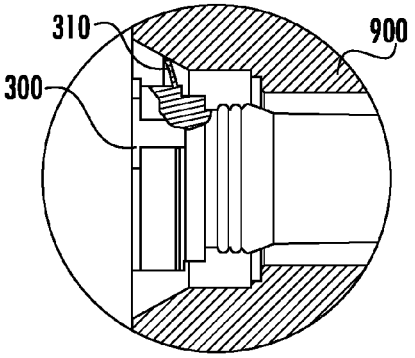
FIG. 4B is a partial, cross-sectional detail view of the post of the coaxial cable connector of FIG. 2 in which the post is inserted into the forming tool further than as illustrated in FIG. 4A using a forming tool and illustrating the contacting portion of the post beginning to form to a contour of the forming tool.
Figure 4C:
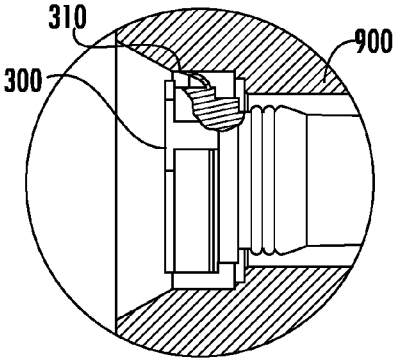
FIG. 4C is a partial cross-sectional detail view of the post of the coaxial cable connector of FIG. 2 in which the post is inserted into the forming tool further than as illustrated in FIGS. 4A and 4B illustrating the contacting portion of the post continuing to form to the contour of the forming tool.
Figure 4D:
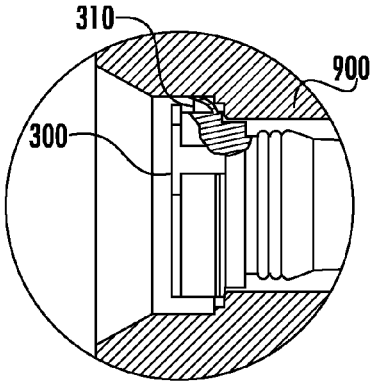
FIG. 4D is a partial cross-sectional detail view of the post of the coaxial cable connector of FIG. 2 in which the post is fully inserted into the forming tool and illustrating the contacting portion of the post forming to the contour of the forming tool.

Referring now to FIGS. 4A, 4B, 4C and 4D the post 300 is illustrated in different states of insertion into a forming tool 900. In FIG. 4A, post 300 is illustrated partially inserted in forming tool 900 with contacting portion 310 of post 300 shown as a protrusion. Protrusion may, but does not have to be radially projecting. In FIG. 4B, contacting portion 310 has begun to advance into forming tool 900. As contacting portion 310 is advanced into forming tool 900, contact portion 310 begins flexibly forming to a contour of the interior of forming tool 900. As illustrated in FIG. 4B, contacting portion 310 is forming to an arcuate or, at least, a partially arcuate shape. As post 300 is further advanced into forming tool 900 as shown in FIG. 4C, contacting portion 310 continues forming to the contour of the interior of forming tool 900. At a final stage of insertion as shown in FIG. 4C contacting portion 310 is fully formed to the contour of forming tool 900, and has experienced deformation in the forming process but retains spring or resilient characteristics based on the elastic/plastic property of the material of contacting portion 310. Upon completion or partial completion of the forming of contacting portion 310, post 300 is removed from forming tool 900 and may be subsequently installed in the connector 100 or other types of coaxial cable connectors. This manner of forming or shaping contacting portion 310 to the contour of forming tool 900 may be useful to aid in handling of post 300 in subsequent manufacturing processes, such as plating for example. Additionally, use of this method makes it possible to achieve various configurations of contacting portion 310 formation as illustrated in FIGS. 5A through 5H.

Figure 5B:
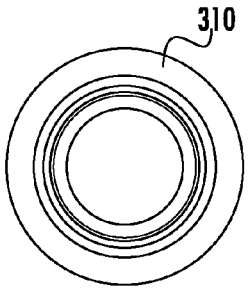
FIGS. 5A through 5H are front and side schematic views of exemplary embodiments of the contacting portions of the post.
Figure 5A:
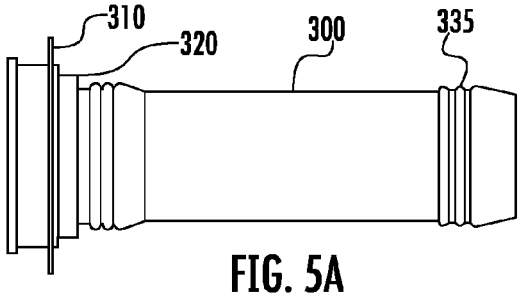
Figure 5D:
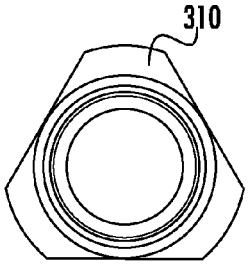
Figure 5C:
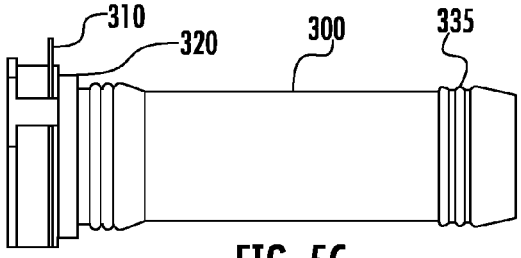
Figure 5F:
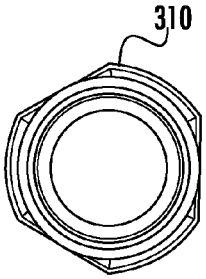
Figure 5E:
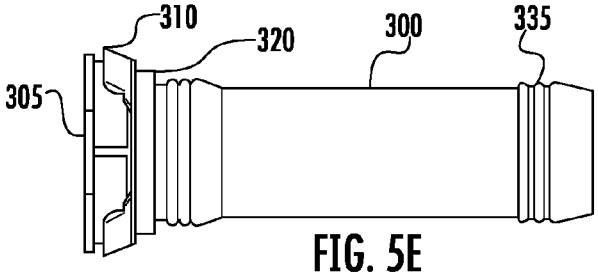
Figure 5H:
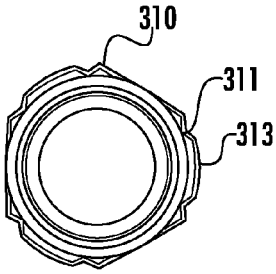
Figure 5G:
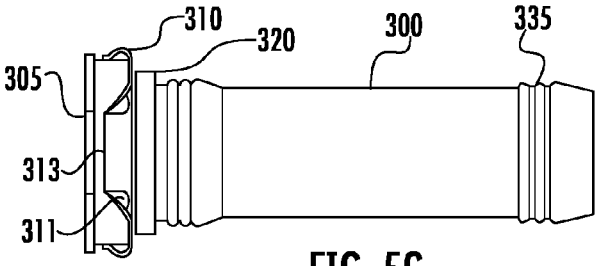

FIG. 5A is a side schematic view of an exemplary embodiment of post 300 where contacting portion 310 is a radially projecting protrusion that completely circumscribes post 300. In this view, contacting portion 310 is formable but has not yet been formed to reflect a contour of coaxial cable connector or forming tool. FIG. 5B is a front schematic view of the post 300 of FIG. 5. FIG. 5C is a side schematic view of an exemplary embodiment of post 300 where contacting portion 310 has a multi-cornered configuration. Contacting portion 310 may be a protrusion and may, but does not have to be, radially projecting. Although in FIG. 5C contacting portion 310 is shown as tri-cornered, contacting portion 310 can have any number of corner configurations, as non-limiting examples, two, three, four, or more. In FIG. 5C, contacting portion 310 may be formable but has not yet been formed to reflect a contour of coaxial cable connector or forming tool. FIG. 5D is a front schematic view of post 300 of FIG. 5C. FIG. 5E is a side schematic view of post 300 where contacting portion 310 has a tri-cornered configuration. In this view, contacting portion 310 is shown as being formed to a shape in which contacting portion 310 cants or slants toward the front end 305 of post 300. FIG. 5F is a front schematic view of post 300 of FIG. 5E. FIG. 5G is a side schematic view of an exemplary embodiment of post 300 where contacting portion 310 has a tri-cornered configuration. In this view contacting portion 310 is formed in a manner differing from FIG. 5E in that indentations 311 in contacting portion 310 result in a segmented or reduced arcuate shape 313. FIG. 5H is a front schematic view of post 300 of FIG. 5G.

It will be apparent to those skilled in the art that contacting portion 310 as illustrated in FIGS. 2-5H may be integral to and monolithic with post 300. Additionally, contacting portion 310 may have or be any shape, including shapes that may be flush or aligned with other portions of post 300, or may have any number of configurations, as non-limiting examples, configurations ranging from completely circular to multi-cornered geometries, and still perform its function of providing electrical continuity. Further, contacting portion 310 may be formable and formed to any shape or in any direction.

Figure 6:
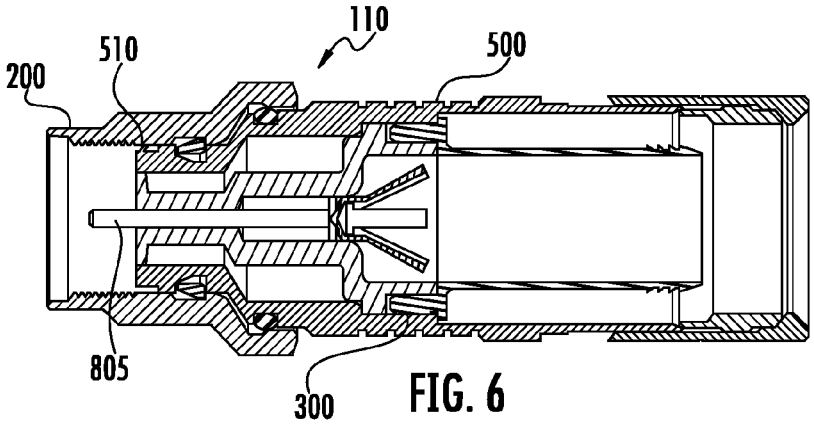
FIG. 6 is a cross-sectional view of an exemplary embodiment of a coaxial cable connector comprising an integral pin, in the state of assembly with body having a contacting portion forming to a contour of the coupler.
Figure 6A:
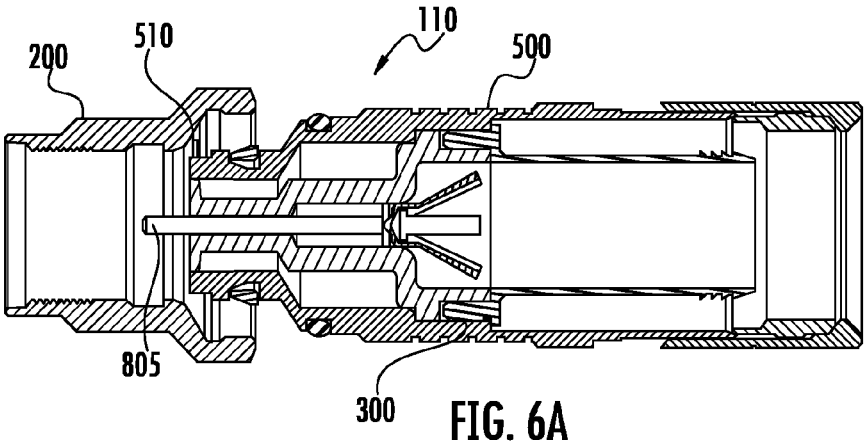
FIG. 6A is a cross-sectional view of the coaxial cable connector illustrated in FIG. 6 in a partial state of assembly illustrating the contacting portion of the body and adapted to form to a contour of the coupler.

FIG. 6 is a cross-sectional view of an exemplary embodiment of a coaxial cable connector 110 comprising an integral pin 805, wherein coupler 200 rotates about body 500 instead of post 300 and contacting portion 510 is a protrusion from, integral to and monolithic with body 500 instead of post 300. In this regard, contacting portion 510 may be a unitized portion of body 500. As such, contacting portion 510 may be constructed with body 500 or a portion of body 500 from a single piece of material. Coaxial cable connector 110 is configured to accept a coaxial cable. Contacting portion 510 may be formed to a contour of coupler 200 as coupler 200 is assembled with body 500 as illustrated in FIG. 6A. FIG. 6A is a cross-sectional view of an exemplary embodiment of a coaxial cable connector 110 in a state of partial assembly. Contacting portion 510 has not been formed to a contour of the coupler 200. Assembling the coupler 200 with the body 500 forms the contacting portion 510 in a rearward facing manner as opposed to a forward facing manner as is illustrated with the contacting portion 310. However, as with contacting portion 310, the material of contacting portion 510 has certain elastic/plastic property which, as contacting portion 510 is formed provides that contacting portion 510 will press against the contour of the coupler 200 and maintain mechanical and electrical contact with coupler 200. Contacting portion 510 provides for electrical continuity from the outer conductor of the coaxial cable to the terminal regardless of the tightness or adequacy of the coupling of the coaxial cable connector 100 to the terminal, and regardless of the tightness of the coaxial cable connector 100 on the terminal in the same way as previously described with respect to contacting portion 310. Additionally or alternatively, contacting portion 310 may be cantilevered or attached at only one end of a segment.

Figure 7:
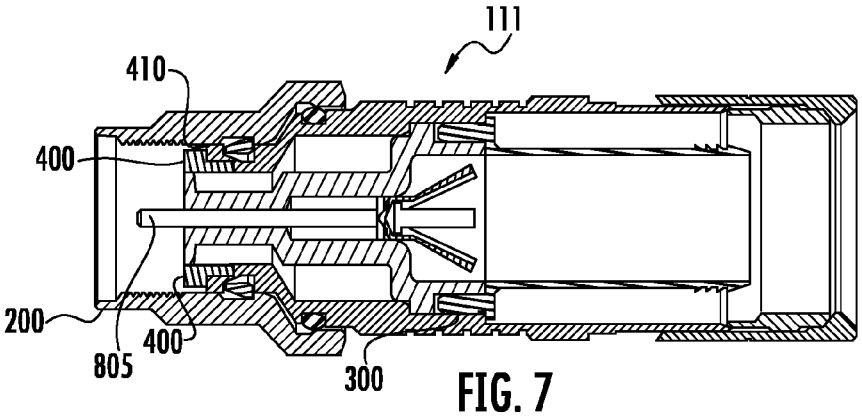
FIG. 7 is a cross-sectional view of an exemplary embodiment of a coaxial cable connector comprising an integral pin, wherein the coupler rotates about a body instead of a post and the contacting portion is part of a component press fit into the body and forming to a contour of the coupler.

FIG. 7 is a cross-sectional view of an exemplary embodiment of a coaxial cable connector 111 comprising an integral pin 805, and a conductive component 400. Coupler 200 rotates about body 500 instead of about a post, which is not present in coaxial cable connector 111. Contacting portion 410 is shown as a protrusion and may be integral to, monolithically with and radially projecting from a conductive component 400 which is press fit into body 500. Contacting portion 410 may be a unitized portion of conductive component 400. As such, the contacting portion 410 may be constructed from a single piece of material with conductive component 400 or a portion of conductive component 400. As with contacting portion 310, the material of contacting portion 410 has certain elastic/plastic property which, as contacting portion 410 is formed provides that contacting portion 410 will press against the contour of the coupler 200 and maintain mechanical and electrical contact with coupler 200 as conductive component 400 inserts in coupler 200 when assembling body 500 with coupler 200 as previously described.

Figure 8:
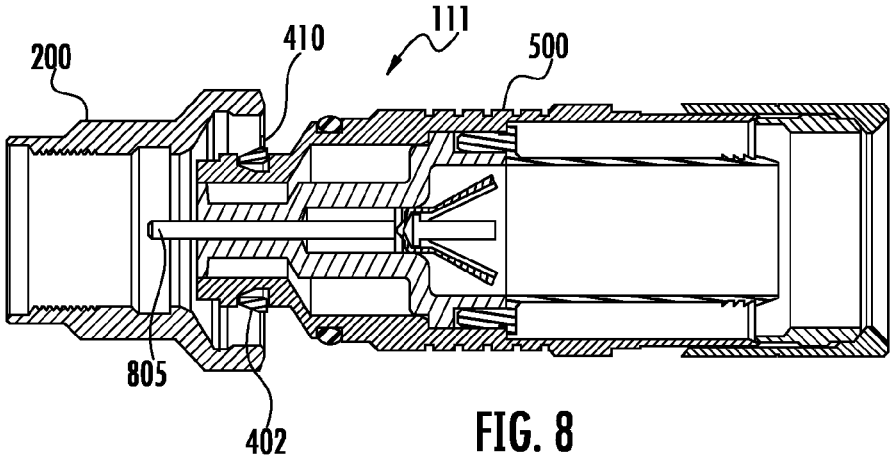
FIG. 8 is a cross-sectional view of an exemplary embodiment of a coaxial cable connector in a partial state of assembly and comprising an integral pin, wherein the coupler rotates about a body instead of a post and the contacting portion is part of a component press position in the body and forming to a contour of the coupler.
Figure 8A:
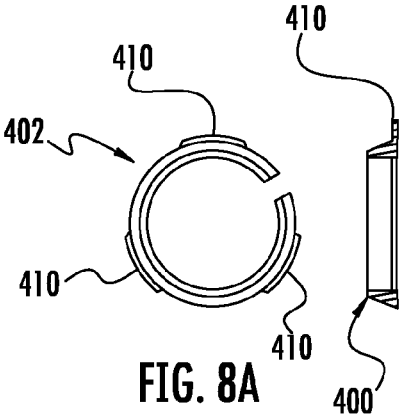
FIG. 8A is a front and side detail view of the component having the contacting portion of the coaxial cable connector of FIG. 8.

FIG. 8 is a cross-sectional view of another exemplary embodiment of the coaxial cable connector 111 comprising an integral pin 805, and a retaining ring 402. The coupler 200 rotates about body 500 instead of a post. Contacting portion 410 may be integral with and radially projecting from a retaining ring 402 which fits into a groove formed in body 500. The contacting portion 410 may be a unitized portion of the retaining ring 402. As such, the contacting portion 410 may be constructed from a single piece of material with the retaining ring 402 or a portion of the retaining ring 402. In this regard, FIG. 8A illustrates front and side views of the retaining ring 402. In FIG. 8A, contacting portion 410 is shown as three protrusions integral with and radially projecting from retaining ring 402. As discussed above, the material of contacting portion 410 has certain elastic/plastic property which, as contacting portion 410 is formed provides that contacting portion 410 will press against the contour of the coupler 200 and maintain mechanical and electrical contact with coupler 200 as retaining ring 402 inserts in coupler 200 when assembling body 500 with coupler 200 as previously described.

It will be apparent to those skilled in the art that the contacting portion 410 as illustrated in FIGS. 6-8A may be integral to the body 500 or may be attached to or be part of another component 400, 402. Additionally, the contacting portion 410 may have or be any shape, including shapes that may be flush or aligned with other portions of the body 500 and/or another component 400, 402, or may have any number of configurations, as non-limiting examples, configurations ranging from completely circular to multi-cornered geometries.

Figure 9:
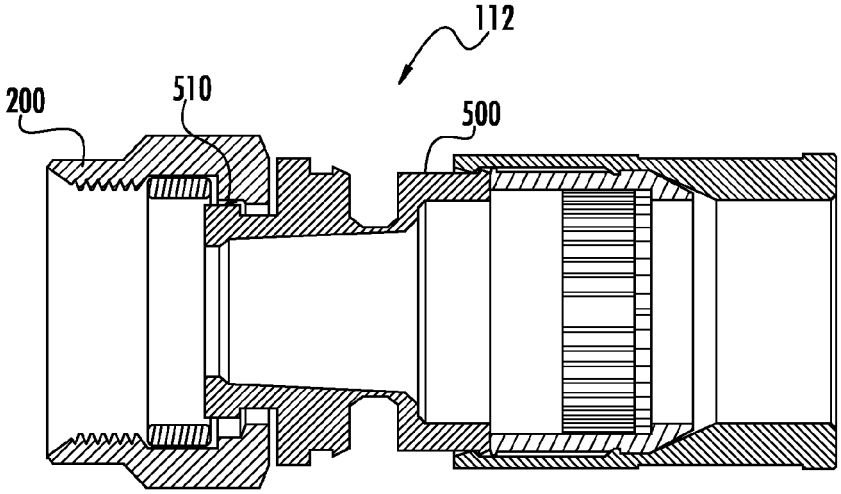
FIG. 9 is a cross sectional view of an exemplary embodiment of a coaxial cable connector comprising a post-less configuration, and a body having a contacting portion forming to a contour of the coupler.

FIG. 9 is a cross-sectional view of an embodiment of a coaxial cable connector 112 that is a compression type of connector with no post. In other words, having a post-less configuration. The coupler 200 rotates about body 500 instead of a post. The body 500 comprises contacting portion 510. The contacting portion 510 is integral with the body 500. As such, the contacting portion 510 may be constructed from a single piece of material with the body 500 or a portion of the body 500. The contacting portion 510 forms to a contour of the coupler 200 when the coupler 200 is assembled with the body 500.

Figure 10:
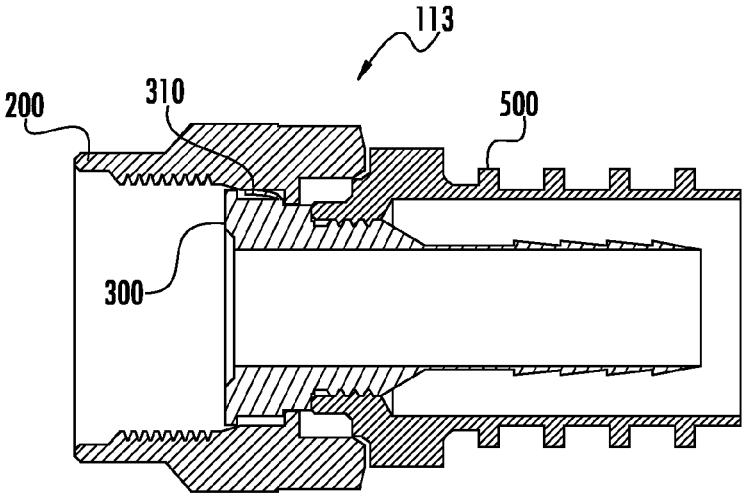
FIG. 10 is a cross sectional view of an exemplary embodiment of a coaxial cable connector comprising a hex crimp body and a post having a contacting portion forming to a contour of the coupler.

FIG. 10 is a cross-sectional view of an embodiment of a coaxial cable connector 113 that is a hex-crimp type connector. The coaxial cable connector 113 comprises a coupler 200, a post 300 with a contacting portion 310 and a body 500. The contacting portion 310 is integral to and monolithic with post 300. Contacting portion 310 may be unitized with post 300. As such, contacting portion 310 may be constructed from a single piece of material with post 300 or a portion of post 300. Contacting portion 310 forms to a contour of coupler 200 when coupler 200 is assembled with body 500 and post 300. The coaxial cable connector 113 attaches to a coaxial cable by means radially compressing body 500 with a tool or tools known in the industry.

Figure 11:
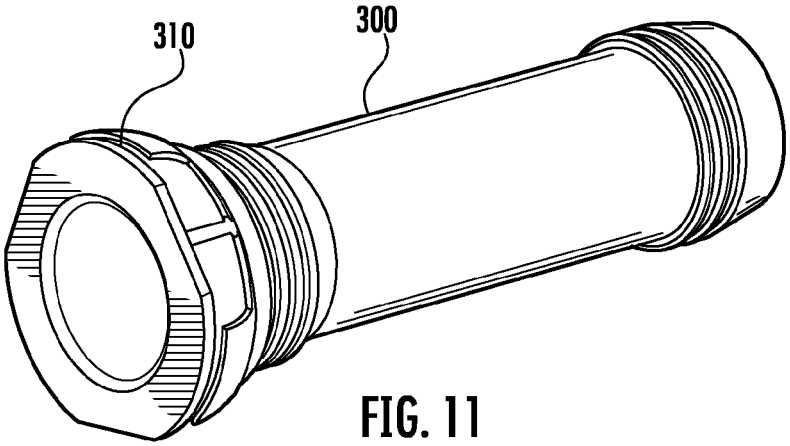
FIG. 11 is an isometric, schematic view of the post of the coaxial cable connector of FIG. 2 wherein the post has a contacting portion in a formed state.

FIG. 11 is an isometric schematic view of post 300 of coaxial cable connector 100 in FIG. 2 with the contacting portion 310 formed to a position of a contour of a coupler (not shown).

Figure 12:
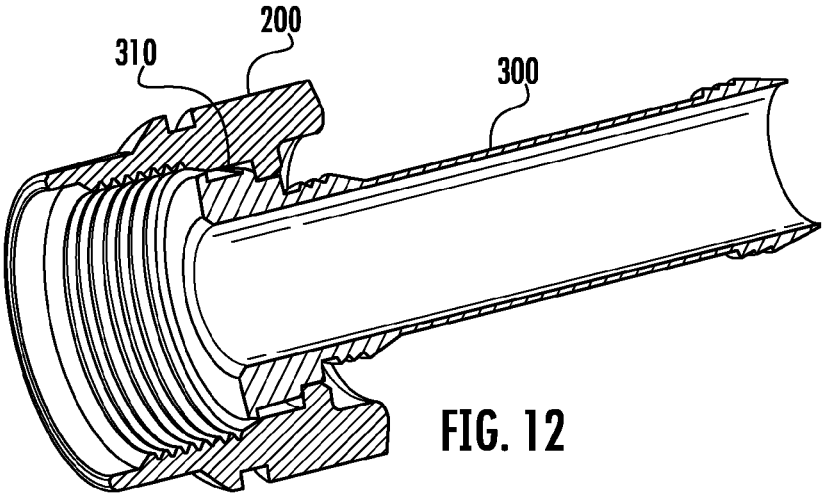
FIG. 12 is an isometric, cross-sectional view of the post and the coupler of the coaxial cable connector of FIG. 2 illustrating the contacting portion of the post forming to a contour of the coupler.

FIG. 12 is an isometric cross sectional view of post 300 and coupler 200 of connector 100 in FIG. 2 illustrated assembled with the post 300. The contacting portion 310 is formed to a contour of the coupler 200.

Figure 13:
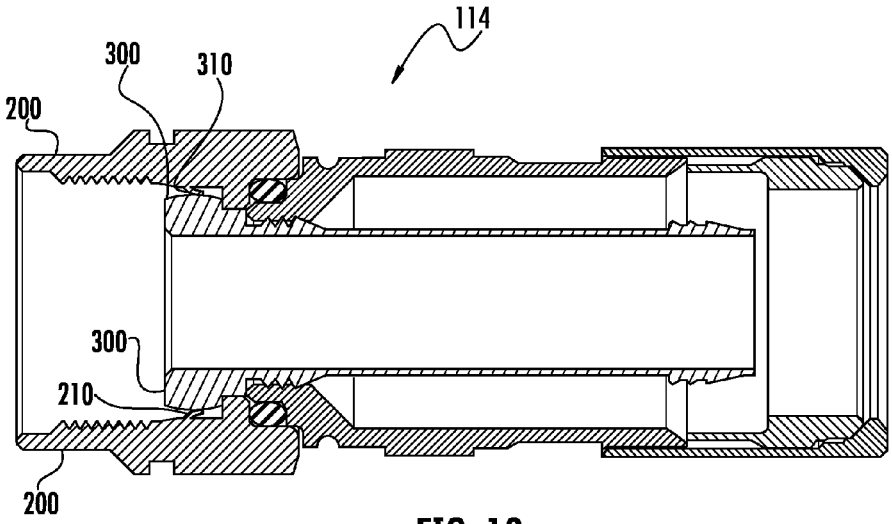
FIG. 13 is a cross-sectional view of an exemplary embodiment of a coaxial cable connector having a coupler with a contacting portion forming to a contour of the post.

FIG. 13 is a cross-sectional view of an embodiment of a coaxial cable connector 114 comprising a post 300 and a coupler 200 having a contacting portion 210. Contacting portion 210 is shown as an inwardly directed protrusion. Contacting portion 210 is integral to and monolithic with coupler 200 and forms to a contour of post 300 when post 300 assembles with coupler 200. Contacting portion 210 may be unitized with coupler 200. As such, contacting portion 210 may be constructed from a single piece of material with coupler 200 or a portion of coupler 200. Contacting portion 210 provides for electrical continuity from the outer conductor of the coaxial cable to the terminal regardless of the tightness or adequacy of the coupling of the coaxial cable connector 114 to the terminal, and regardless of the tightness of coaxial cable connector 114 on the terminal. Contacting portion 210 may have or be any shape, including shapes that may be flush or aligned with other portions of coupler 200, or may have and/or be formed to any number of configurations, as non-limiting examples, configurations ranging from completely circular to multi-cornered geometries.

Figure 14:
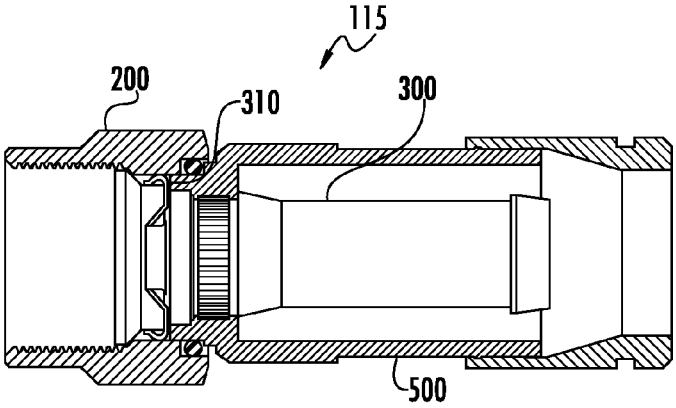
FIG. 14 is a cross-sectional view of an exemplary embodiment of a coaxial cable connector having a post with a contacting portion forming to a contour of the coupler.
Figure 15:
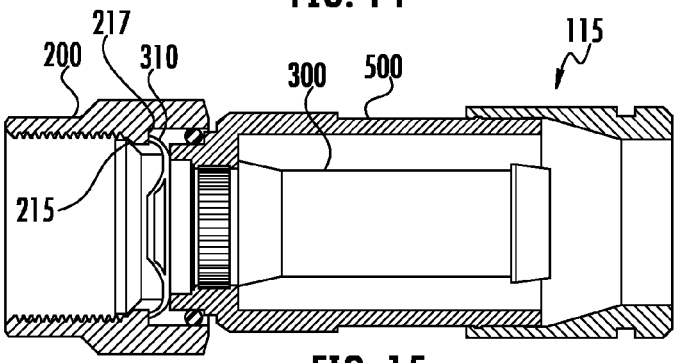
FIG. 15 is a cross-sectional view of an exemplary embodiment of a coaxial cable connector having a post with a contacting portion forming to a contour behind a lip in the coupler toward the rear of the coaxial cable connector.
Figure 16:
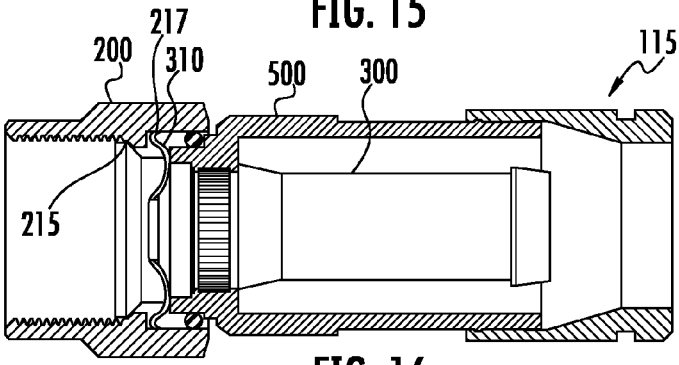
FIG. 16 is a cross-sectional view of an exemplary embodiment of a coaxial cable connector having a post with a contacting portion forming to a contour behind a lip in the coupler toward the rear of the coaxial cable connector.

FIGS. 14, 15 and 16 are cross-sectional views of embodiments of coaxial cable connectors 115 with a post similar to post 300 comprising a contacting portion 310 as described above such that the contacting portion 310 is shown as outwardly radially projecting, which forms to a contour of the coupler 200 at different locations of the coupler 200. Additionally, the contacting portion 310 may contact the coupler 200 rearward of the lip 215, for example as shown in FIGS. 15 and 16, which may be at the rearward facing surface 217 of the lip 215, for example as shown in FIG. 15.

Figure 17:
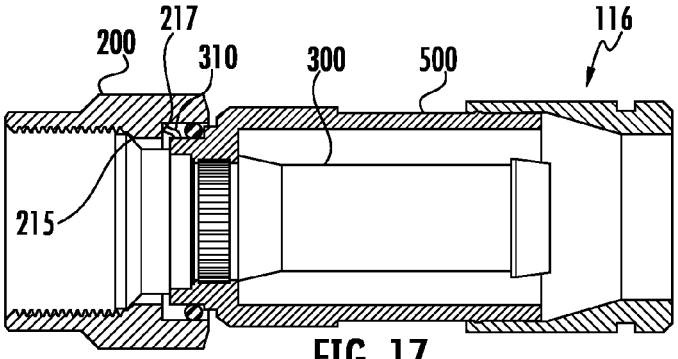
FIG. 17 is a cross-sectional view of an exemplary embodiment of a coaxial cable connector having a body with a contacting portion forming to a contour behind a lip in the coupler toward the rear of the coaxial cable connector.

FIG. 17 is a cross-sectional view of an embodiment of a coaxial cable connector 116 with a body 500 comprising a contacting portion 310, wherein the contacting portion 310 is shown as an outwardly directed protrusion from body 500 that forms to the coupler 200.

Figure 18:
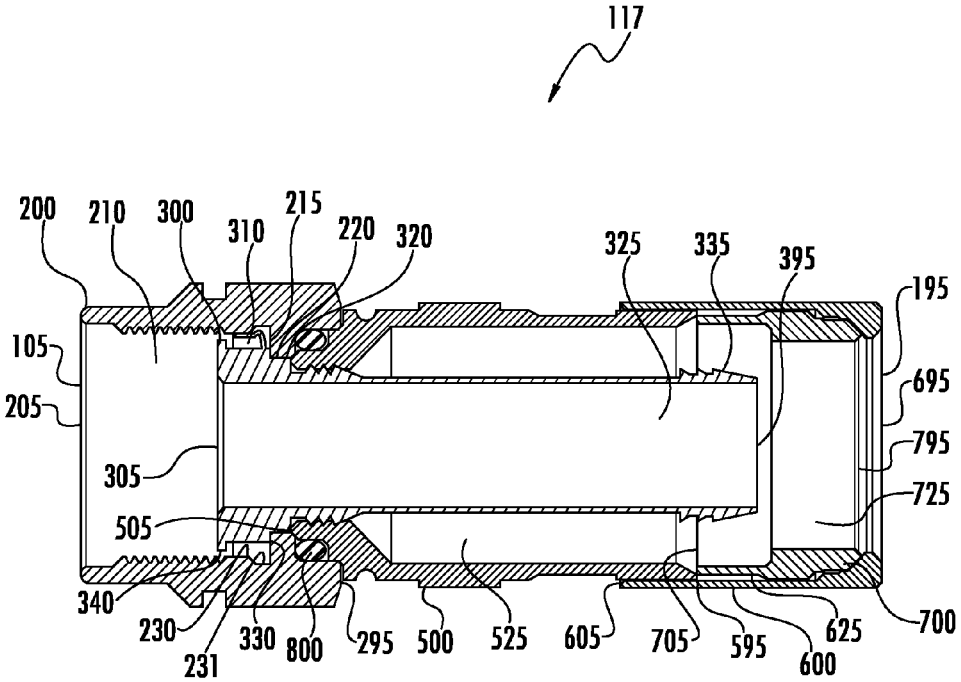
FIG. 18 is a cross-sectional view of an exemplary embodiment of a coaxial cable connector having a post with a contacting portion forming to a contour of a coupler with an undercut.
Figure 18A:
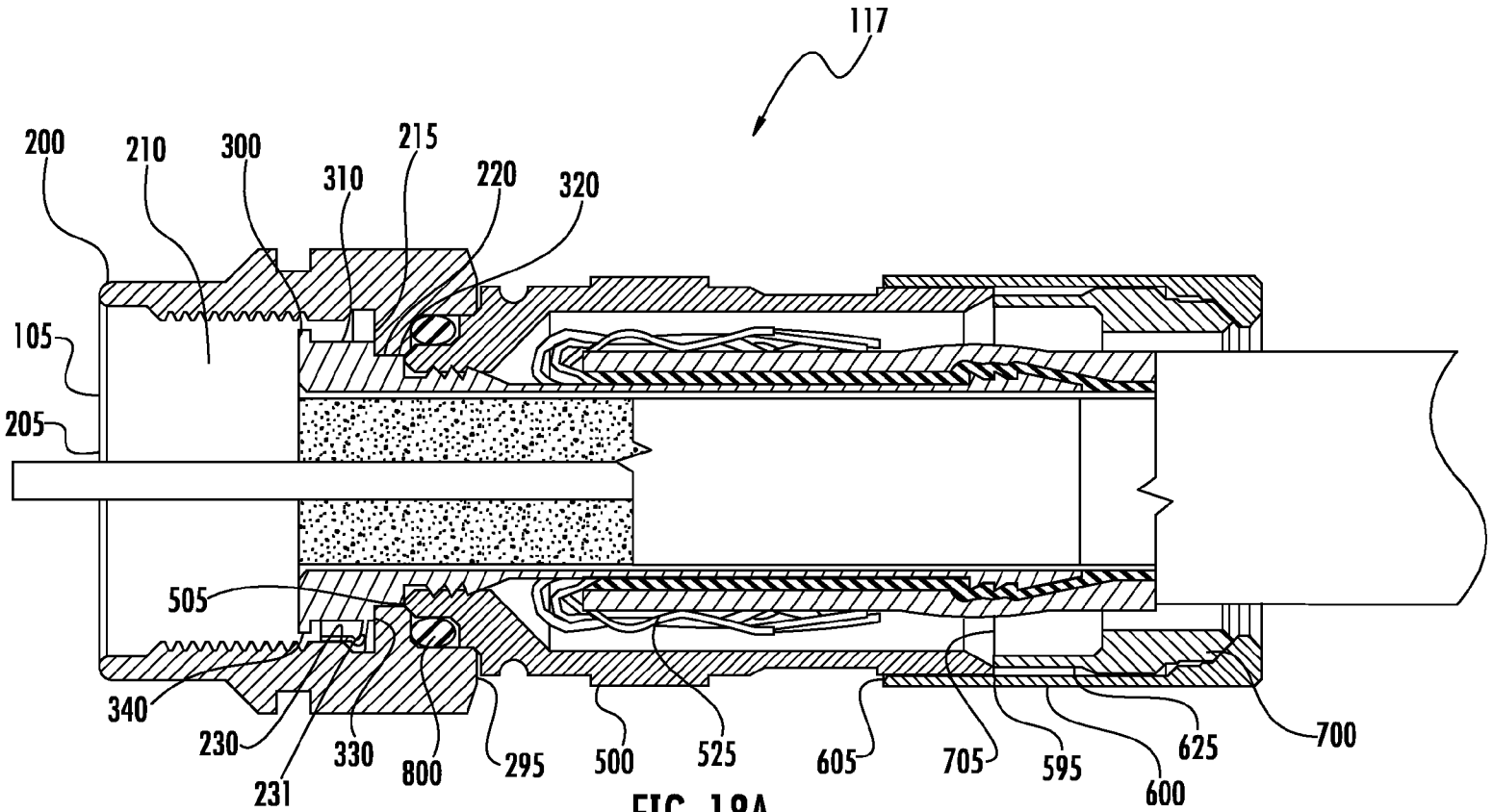
FIG. 18A is a partial, cross-sectional view of an exemplary embodiment of a coaxial cable connector having a post with a contacting portion forming to a contour of a coupler with an undercut having a prepared coaxial cable inserted in the coaxial cable connector.

FIG. 18 is a cross-sectional view of an embodiment of a coaxial cable connector 117 having a post 300 with an integral contacting portion 310 and a coupler 200 with an undercut 231. The contacting portion 310 is shown as a protrusion that forms to the contours of coupler 200 at the position of undercut 231. FIG. 18A is a cross-sectional view of the coaxial cable connector 117 as shown in FIG. 18 having a prepared coaxial cable inserted in the coaxial cable connector 117. The body 500 and the post 300 receive the coaxial cable (FIG. 18A). The post 300 at the back end 395 is inserted between an outer conductor and a dielectric layer of the coaxial cable.

Figure 19:
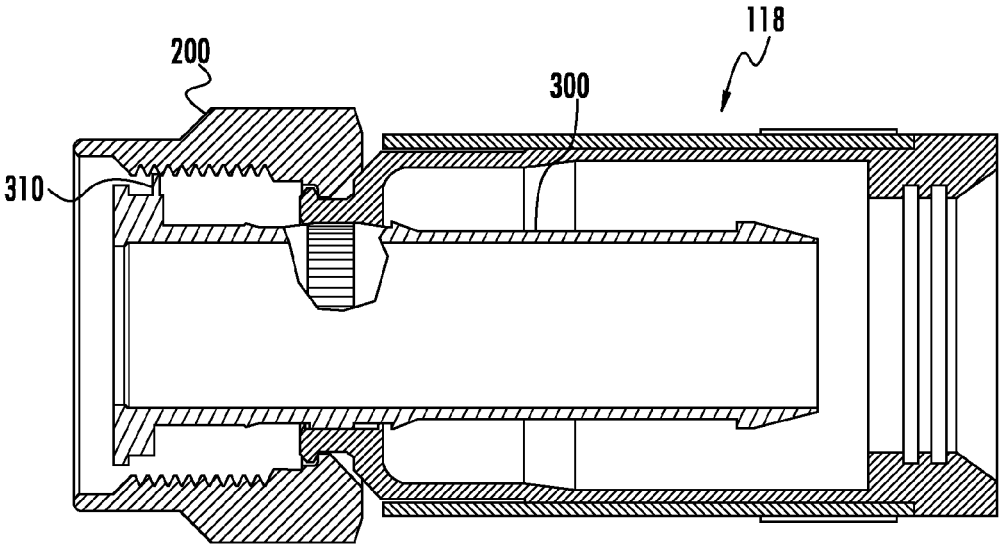
FIG. 19 is a partial, cross-sectional view of an exemplary embodiment of a coaxial cable connector having a moveable post with a contacting portion wherein the post is in a forward position.
Figure 20:
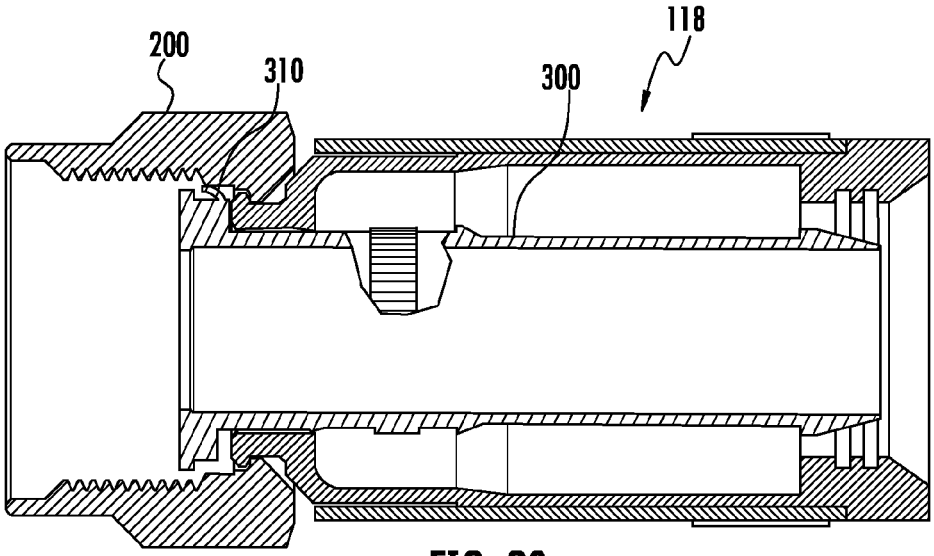
FIG. 20 is a partial cross sectional view of the coaxial cable connector of FIG. 19 with the movable post in a rearward position and the contacting portion of the movable post forming to a contour of the coupler.

FIG. 19 is a partial, cross-sectional view of an embodiment of a coaxial cable connector 118 having a post 301 comprising an integral contacting portion 310. The movable post 301 is shown in a forward position with the contacting portion 310 not formed by a contour of the coupler 200. FIG. 20 is a partial, cross-sectional view of the coaxial cable connector 118 shown in FIG. 19 with the post 301 in a rearward position and the contacting portion 310 forming to a contour of the coupler 200.

Figure 21:
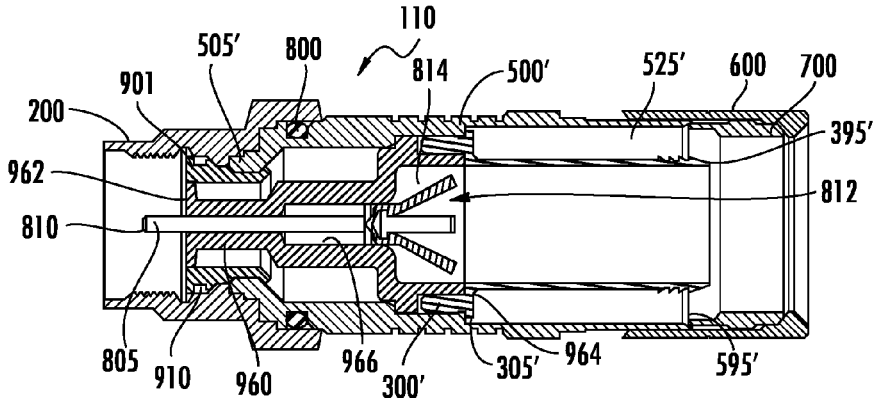
FIG. 21 is a cross-sectional view of an exemplary embodiment of a coaxial cable connector comprising an integral pin.

Referring now to FIG. 21, an exemplary embodiment of a coaxial cable connector 110 configured to accept a coaxial cable and comprising an integral pin 805 is illustrated. The coaxial cable connector 110 has a coupler 200, which rotates about body 500', and retainer 901. Coaxial cable connector 110 may include post 300', O-ring 800, insulating member 960, shell 600, and deformable gripping member 700. O-ring 800 may be made from a rubber-like material, such as EPDM (Ethylene Propylene Diene Monomer). Body 500' has front end 505', back end 595', and a central passage 525' and may be made from a metallic material, such as brass, and plated with a conductive, corrosion resistant material, such as nickel. Insulating member 960 includes a front end 962, a back end 964, and an opening 966 between the front and rear ends and may be made of an insulative plastic material, such as high-density polyethylene or acetal. At least a portion of back end 964 of insulating member 960 is in contact with at least a portion of post 300'. Post 300' includes front end 305' and rear end 395' and may be made from a metallic material, such as brass, and may be plated with a conductive, corrosion resistant material, such as tin. Deformable gripping member 700 may be disposed within the longitudinal opening of shell 600 and may be made of an insulative plastic material, such as high-density polyethylene or acetal. Pin 805 has front end 810, back end 812, and flared portion 814 at its back end 812 to assist in guiding an inner conductor of a coaxial cable into physical and electrical contact with pin 805. Pin 805 is inserted into and substantially along opening 966 of insulating member 960 and may be made from a metallic material, such as brass, and may be plated with a conductive, corrosion resistant material, such as tin. Pin 805 and insulating member 960 are rotatable together relative to body 500' and post 300'.

Figure 22:
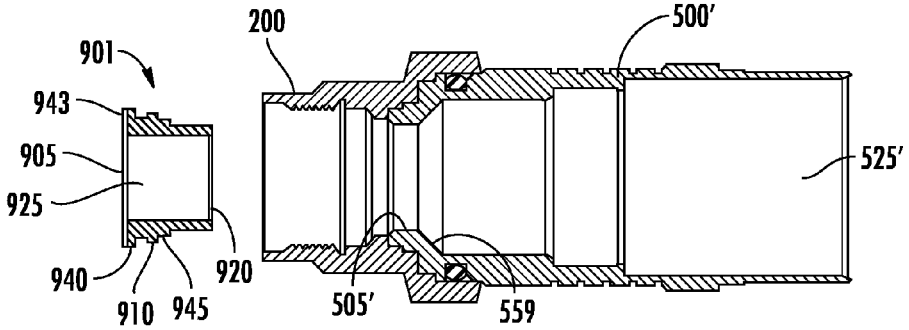
FIG. 22 is a cross-sectional view of the coaxial cable connector illustrated in FIG. 21 in a partial state of assembly illustrating the contacting portion of the retainer and adapted to form to a contour of the coupler.

Referring also now to FIG. 22 with FIG. 21, retainer 901 may be tubular and comprise a front end 905, a back end 920, and a contacting portion 910. Contacting portion 910 may be in the form of a protrusion extending from retainer 901. Contacting portion 910 may, but does not have to be, radially projecting. Contacting portion may be integral to and monolithic with retainer 901. In this regard, contacting portion 910 may be may be a unitized portion of retainer 901. As such, contacting portion 910 may be constructed with retainer 901 from a single piece of material. The retainer 901 may be made of metal such as brass and plated with a conductive material such as tin. Retainer 901 may also comprise an enlarged shoulder 940, flange 943, collar portion 945, and a through-bore 925. Contacting portion 910 may be formed to a contour of coupler 200 as retainer 901 is assembled with body 500 as illustrated in FIG. 22 through FIG. 25.

Continuing with reference to FIG. 22, there is shown a cross-sectional view of the coaxial cable connector 110 partially assembled with body 500' engaged with coupler 200 but with retainer 901 separate therefrom. In other words, in FIG. 22, retainer 901 is shown as not yet being inserted in coupler 200. Since retainer 901 is not inserted in coupler 200, contacting portion 910 has not yet been formed to a contour of the coupler 200. However, contacting portion 910 may be adapted to form to a contour of coupler 200.

Figure 23:
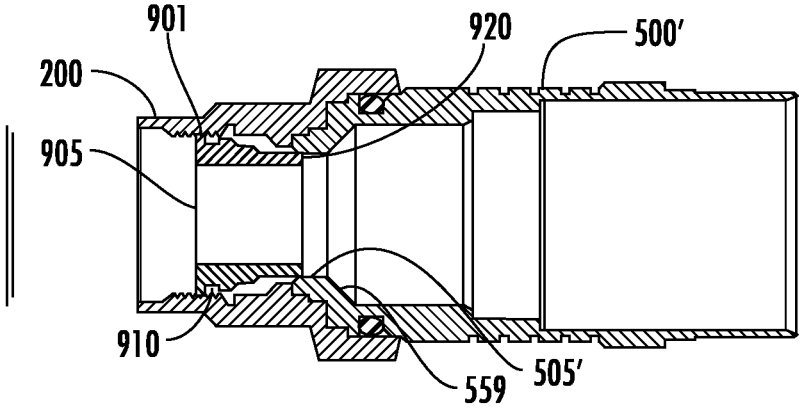
FIG. 23 is a cross-sectional view of the coaxial cable connector illustrated in FIG. 21 in a partial state of successively further assembly illustrating the contacting portion of the retainer and adapted to form to a contour of the coupler.

FIG. 23 illustrates coaxial cable connector 110 in a further partial state assembly than as illustrated in FIG. 22 with retainer 901 partially inserted in coupler 200. In FIG. 23, contacting portion 910 is shown as beginning to form to a contour of coupler 200. Assembling the retainer 901 with coupler 200 and body 500' (as seen in successive FIGS. 24 and 25) continues forming the contacting portion 910 in a manner similar to embodiments having a post with a contacting portion 310 as previously described. As with contacting portion 310, the material of contacting portion 910 has certain elastic/plastic property which, as contacting portion 910 is formed, provides that contacting portion 910 may press against or be biased toward the contour of coupler 200 and, thereby, contacting portion 910 may maintain mechanical and electrical contact with coupler 200. In this way, contacting portion 910 provides for electrical continuity through itself, and coupler 200 and body 500' from the outer conductor of the coaxial cable to the terminal regardless of the tightness or adequacy of the coupling of the coaxial cable connector 110 to the terminal, and regardless of the tightness of the coaxial cable connector 110 on the terminal, in the same way as previously described with respect to contacting portion 310. In other words, electrical continuity may be established through the coupler 200, the post 300', the body 500' and the retainer 901 other than by the use of a component unattached from or independent of the coupler 200, the post 300', body 500', and retainer 901 to provide RF shielding such that the integrity of an electrical signal transmitted through coaxial cable connector 110 is maintained regardless of the tightness of the coupling of the connector to the terminal. Maintaining electrical continuity and, thereby, a stable ground path, protects against the ingress of undesired or spurious RF signals which may degrade performance of the appliance. In such a way, the integrity of the electrical signal transmitted through coaxial cable connector 110 may be maintained. This is especially applicable when the coaxial cable connector 110 is not fully tightened to the equipment connection port, either due to not being tightened upon initial installation or due to becoming loose after installation. Contacting portion 910 may be cantilevered from and/or attached to retainer 910 at only one end of a segment of contacting portion 910.

Figure 24:
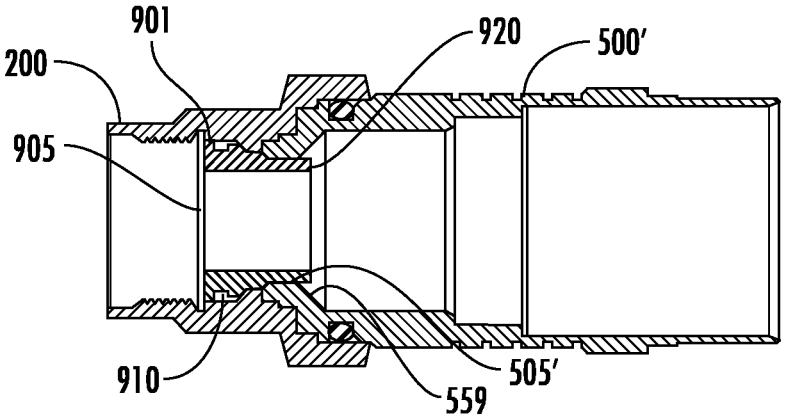
FIG. 24 is a cross-sectional view of the coaxial cable connector illustrated in FIG. 21 in a partial state of yet successively further assembly illustrating the contacting portion of the retainer and adapted to form to a contour of the coupler wherein the retainer is in an un-flared condition.

Referring now to FIG. 24, coaxial cable connector 110 is illustrated in a further partial state of assembly than as illustrated in FIG. 23, with retainer 901 fully inserted in coupler 200 and press fit into body 500. In FIG. 24, back end 920 of retainer 901 is not flared out. In other words, retainer 901 is shown in an un-flared condition. Contacting portion 910 is illustrated as formed to and within contour of coupler 200.

Figure 25:
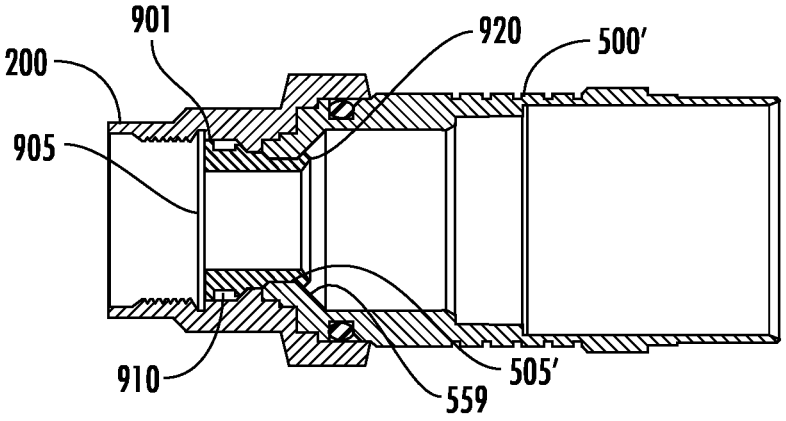
FIG. 25 is cross-sectional views of the coaxial cable connector illustrated in FIG. 21 in a partial state of still yet successively further assembly illustrating the contacting portion of the retainer and adapted to form to a contour of the coupler where in the retainer is in a final flared condition.

FIG. 25 is an illustration coaxial cable connector 110 in a further partial state of assembly than as illustrated in FIG. 24. In FIG. 24, in addition to retainer 901 being fully inserted in coupler 200 and press fit into body 500', back end 920 of retainer 901 is shown as flared within contours 559 of body 500'. In other words, retainer 901 is shown in a flared condition. Flaring of back end 920 secures retainer 901 within body 500'. It will be apparent to those skilled in the art that the contacting portion 910 as illustrated in FIGS. 21-25 may be integral to the retainer 901 or may be attached to or be part of another component. Additionally, the contacting portion 910 may have or be any shape, including shapes that may be flush or aligned with other portions of the body 500' and/or another component, or may have any number of configurations, as non-limiting examples, configurations ranging from completely circular to multi-cornered geometries.

Figure 26:
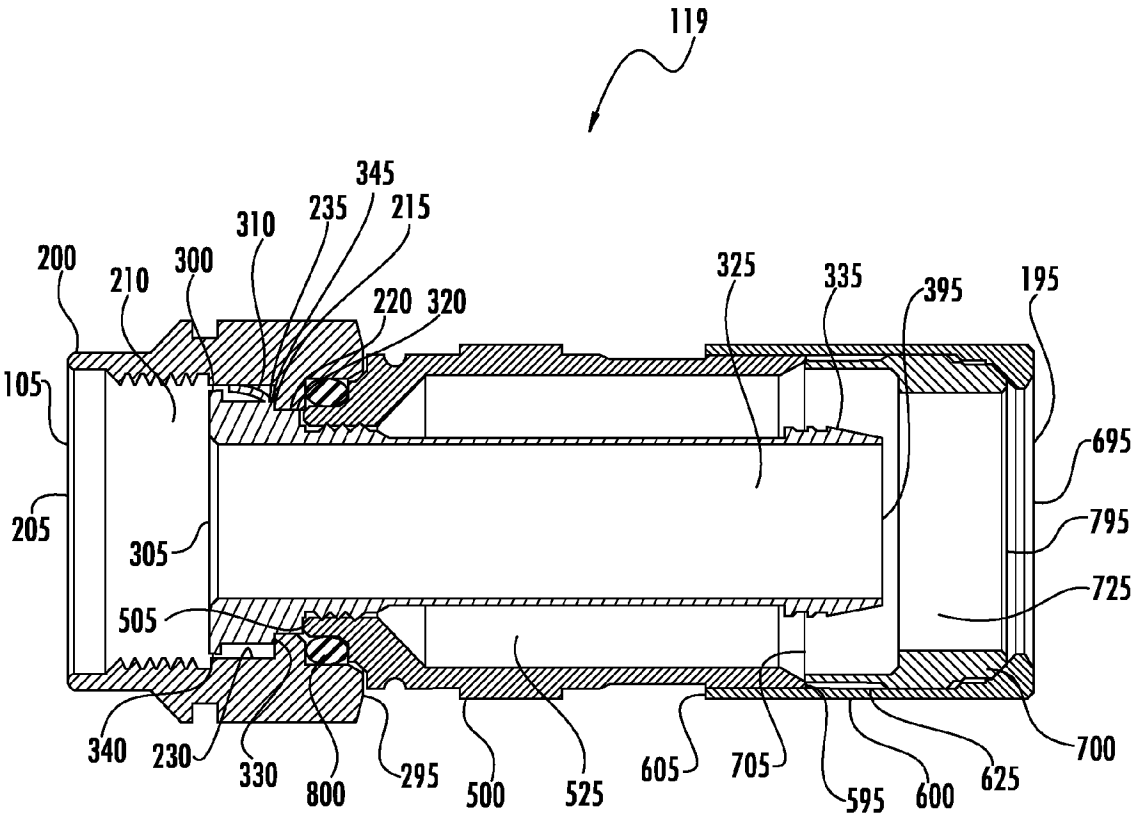
FIG. 26 is a side, cross sectional view of an exemplary embodiment of an assembled coaxial cable connector providing for circuitous electrical paths at the coupler to form an integral Faraday cage for RF protection.

In this regard, FIG. 26 illustrates a coaxial cable connector 119 having front end 105, back end 195, coupler 200, post 300, body 500, compression ring 600 and gripping member 700. Coupler 200 is adapted to couple the coaxial cable connector 119 to a terminal, which includes an equipment connection port. Body 500 is assembled with the coupler 200 and post 300. The post 300 is adapted to receive an end of a coaxial cable. Coupler 200 comprises front end 205, back end 295 central passage 210, lip 215, through-bore 220, bore 230 and bore 235. Coupler 200 may be made of metal such as brass and plated with a conductive material such as nickel. Post 300 comprises front end 305, back end 395, contacting portion 310, enlarged shoulder 340, collar portion 320, through-bore 325, rearward facing annular surface 330, shoulder 345 and barbed portion 335 proximate back end 395. Post 300 may be made of metal such as brass and plated with a conductive material such as tin. Contacting portion 310 is integral and monolithic with post 300. Contacting portion 310 provides a stable ground path and protects against the ingress and egress of RF signals. Body 500 comprises front end 505, back end 595, and central passage 525. Body 500 may be made of metal such as brass and plated with a conductive material such as nickel. Shell 600 comprises front end 605, back end 695, and central passage 625. Shell 600 may be made of metal such as brass and plated with a conductive material such as nickel. Gripping member 700 comprises front end 705, back end 795, and central passage 725. Gripping member 700 may be made of a polymer material such as acetal.

Although, coaxial cable connector 119 in FIG. 26 is an axial-compression type coaxial connector having post 300, contacting portion 310 may be incorporated in any type of coaxial cable connector. Coaxial cable connector 119 is shown in its unattached, uncompressed state, without a coaxial cable inserted therein. Coaxial cable connector 119 couples a prepared end of a coaxial cable to a threaded female equipment connection port (not shown in FIG. 26). Coaxial cable connector 119 has a first end 105 and a second end 195. Shell 600 slideably attaches to the coaxial cable connector 119 at back end 595 of body 500. Coupler 200 attaches to coaxial cable connector 119 at back end 295. Coupler 200 may rotatably attach to front end 305 of post 300 while engaging body 300 by means of a press-fit. Contacting portion 310 is of monolithic construction with post 300, being formed or constructed in a unitary fashion from a single piece of material with post 300. Post 300 rotatably engages central passage 210 of coupler 200 lip 215. In this way, contacting portion 310 provides an electrically conductive path between post 300, coupler 200 and body 500. This enables an electrically conductive path from the coaxial cable through the coaxial cable connector 119 to the equipment connection port providing an electrical ground and a shield against RF ingress. Elimination of separate continuity member 4000 as illustrated in connector 1000 of FIG. 1 improves DC contact resistance by eliminating mechanical and electrical interfaces between components and further improves DC contact resistance by removing a component made from a material having higher electrical resistance properties.

An enlarged shoulder 340 at front end 305 extends inside coupler 200. Enlarged shoulder 340 comprises flange 312, contacting portion 310, collar portion 320, rearward facing annular surface 330 and shoulder 345. Collar portion 320 allows coupler 200 to rotate by means of a clearance fit with through bore 220 of coupler 200. Rearward facing annular surface 330 limits forward axial movement of coupler 200 by engaging lip 215. Contacting portion 310 contacts coupler 200 forward of lip 215. Contacting portion 310 may be formed to contactedly fit with the coupler 200 by utilizing coupler 200 to form contacting portion 310 upon assembly of coaxial cable connector 119 components. In this manner, contacting portion 310 is secured within coaxial cable connector 119, and establishes mechanical and electrical contact with coupler 200 and, thereby, an electrically conductive path between post 300 and coupler 200. Further, contacting portion 310 remains contactedly fit, in other words in mechanical and electrical contact, with coupler 200 regardless of the tightness of coaxial cable connector 119 on the appliance equipment connection port. In this manner, contacting portion 310 is integral to the electrically conductive path established between post 300 and coupler 200 even when the coaxial cable connector 119 is loosened and/or disconnected from the appliance equipment connection port. Post 300 has a front end 305 and a back end 395. Back end 395 is adapted to extend into a coaxial cable. Proximate back end 395, post 300 has a barbed portion 335 extending radially outwardly from the tubular post 300.

Figure 27:
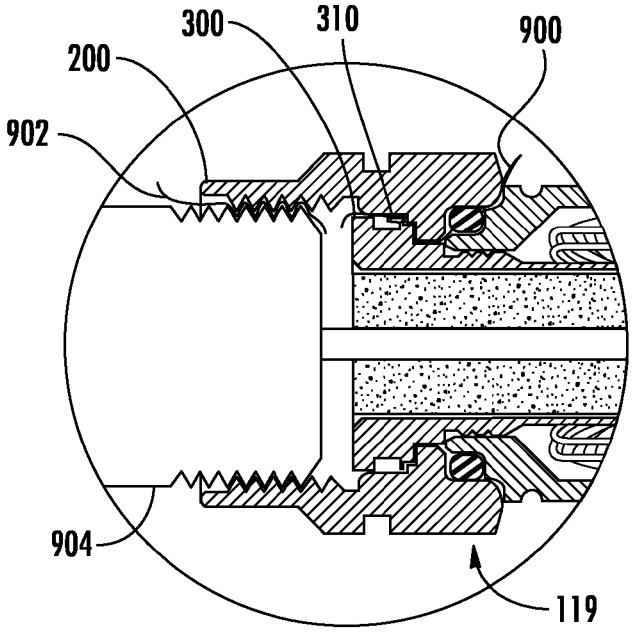
FIG. 27 is a partial, cross-sectional detail view of the assembled coaxial cable connector of FIG. 26 illustrating a circuitous path between the coupler, post and body another circuitous path between the coupler and the equipment connection port.
Figure 28:
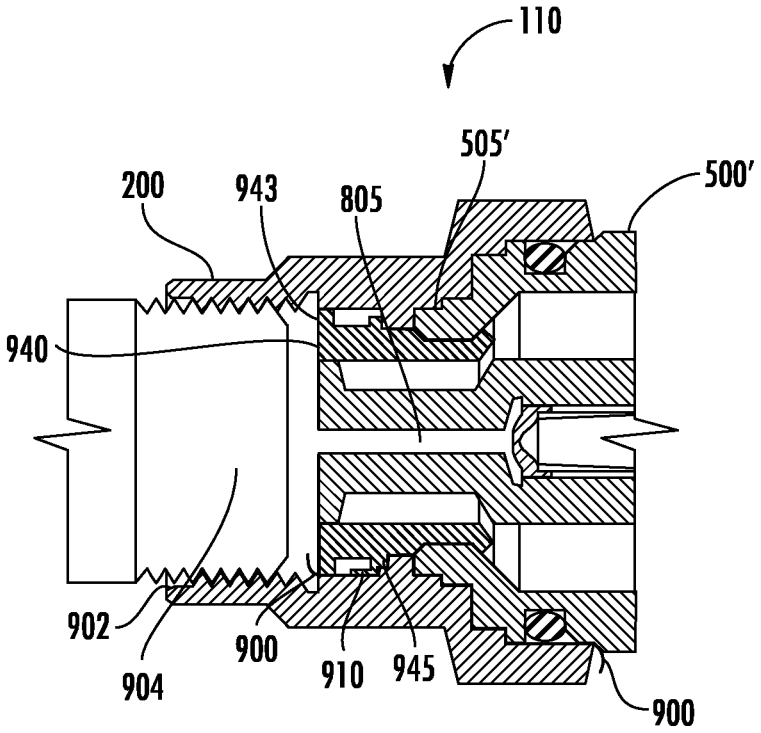
FIG. 28 is a partial, cross-sectional detail view of the assembled coaxial cable connector of FIG. 21 illustrating a circuitous path between the coupler, retainer and body another circuitous path between the coupler and the equipment connection port.
Figure 29:
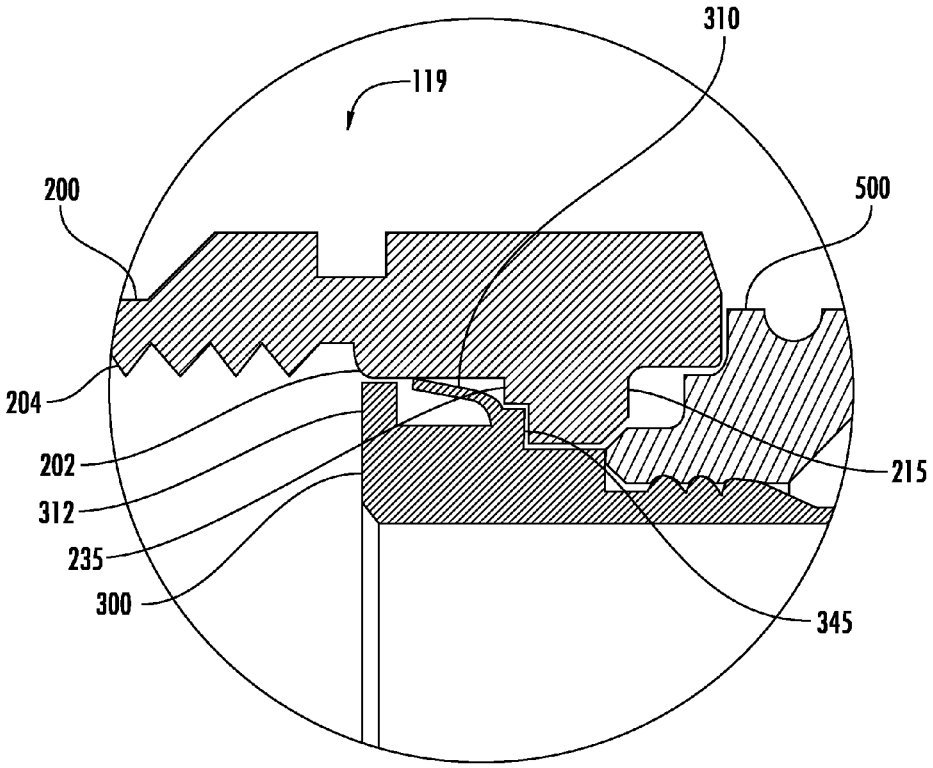
FIG. 29 is a partial, cross sectional detail view of the coupler, the post and the body of FIG. 27.

FIGS. 27 and 28 illustrate two paths 900, 902. In FIG. 27, coaxial cable connector 119 includes structures to increase the attenuation of RF ingress or egress via paths 900, 902. RF leakage may occur via path 900 through coupler 200 back end 295 at the body 500 and between the lip 215 and post 300. However, as shown in FIG. 29, step 235 and shoulder 345, along with contacting portion 310 and flange 312 form a circuitous path along path 900. The structure of the coupler 200 and post 300 closes off or substantially reduces a potential RF leakage path along path 900, thereby increasing the attenuation of RF ingress or egress signals. In this way, coupler 200 and post 500 provide RF shielding such that RF signals external to the coaxial cable connector 119 are attenuated such that the integrity of an electrical signal transmitted through coaxial cable connector 119 is maintained regardless of the tightness of the coupling of the connector to equipment connection port 904.

In FIG. 28, coaxial cable connector 110 is illustrated, and, in a similar fashion with coaxial cable connector 119, structures to increase the attenuation of RF ingress or egress via paths 900, 902. Instead of post 300, FIG. 28 shows retainer 901 with a collar portion 945 and shoulder 940, along with contacting portion 910 and flange 943, which form a circuitous path along path 900. The structure of the coupler 200 and post 300 closes off or substantially reduces a potential RF leakage path along path 900, thereby increasing the attenuation of RF ingress or egress signals. In this way, coupler 200 and retainer 901 provide RF shielding such that RF signals external to the coaxial cable connector 110 are attenuated such that the integrity of an electrical signal transmitted through coaxial cable connector 110 is maintained regardless of the tightness of the coupling of the connector to equipment connection port 904.

With reference again to FIGS. 27 and 28, RF leakage via path 902 may be possible along threaded portion of coupler 200 to equipment connection port 904. This is particularly true when the coaxial cable connectors 110, 119 are in a dynamic condition such as during vibration or other type of externally induced motion. Under these conditions electrical ground can be lost and an RF ingress path opened when the threads 204 of the coupler 200 and the threads 906 of the equipment connection port 904 become coaxially aligned reducing or eliminating physical contact between the coupler 200 and the equipment connection port 904. By modifying the form of the coupler 200 threads 204 the tendency of the coupler 200 to equipment connection port 904 to lose ground contact and open an RF ingress path via path 902 is mitigated, thereby increasing the attenuation of RF ingress or egress signals.

Figure 30:
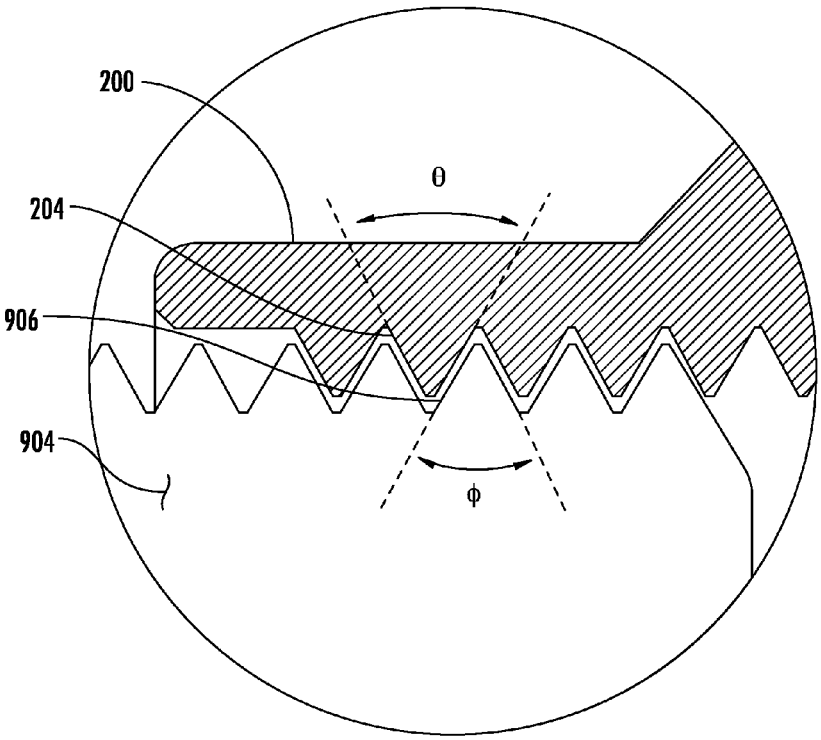
FIG. 30 is a partial, cross-sectional detail view of the threads of an equipment connection port and the threads of the coupler of the assembled coaxial cable connector of FIG. 27.

The structure of the threads 204 of the coupler 200 may involve aspects including, but are not limited to, pitch diameter of the thread, major diameter of the thread, minor diameter of the thread, thread pitch angle "θ", thread pitch depth, and thread crest width and thread root radii. Typically, the pitch angle "θ" of thread 204 of coupler 200 is designed to match, as much as possible, the pitch angle "ϕ" of thread 906 of equipment connection port 904. As shown in FIG. 30, pitch angle "θ" may be different than pitch angle "ϕ" to reduce interfacial gap between thread 204 of coupler 200 and thread 906 of equipment connection port 904. In this way, the threaded portion of the coupler 200 traverses a shorter distance before contacting the threaded portion of the equipment connection port 904 closing off or substantially reducing a potential RF leakage path along path 902. Typically, thread 906 angle "ϕ" of the equipment connection port 904 is set at 60 degrees. As a non-limiting example, instead of designing coupler 200 with threads 204 of angle "θ", angle "θ" may be set at about 62 degrees which may provide the reduced interfacial gap as discussed above. In this way, coupler 200 and post 500 provide RF shielding such that RF signals external to the coaxial cable connector 110, 119 are attenuated such that the integrity of an electrical signal transmitted through coaxial cable connector 110, 119 is maintained regardless of the tightness of the coupling of the connector to equipment connection port 904.

Typically, RF signal leakage is measured by the amount of signal loss expressed in decibel ("dB"). Therefore, "dB" relates to how effectively RF shielding is attenuating RF signals. In this manner, RF signal ingress into a coaxial cable connectors 110, 119 or egress out from a coaxial cable connector 110, 119 may be determined, and, thereby, the ability of the RF shielding of a coaxial cable connector 110, 119 to attenuate RF signals external to the coaxial cable connector 110, 119. Accordingly, the lower the value of "dB" the more effective the attenuation. As an example, a measurement RF shielding of −20 dB would indicate that the RF shield attenuates the RF signal by 20 dB as compared at the transmission source. For purposes herein, RF signals external to the coaxial cable connector 110, 119 include either or both of RF signal ingress into a coaxial cable connector 119 or egress out from a coaxial cable connector 110, 119.

Figure 31:
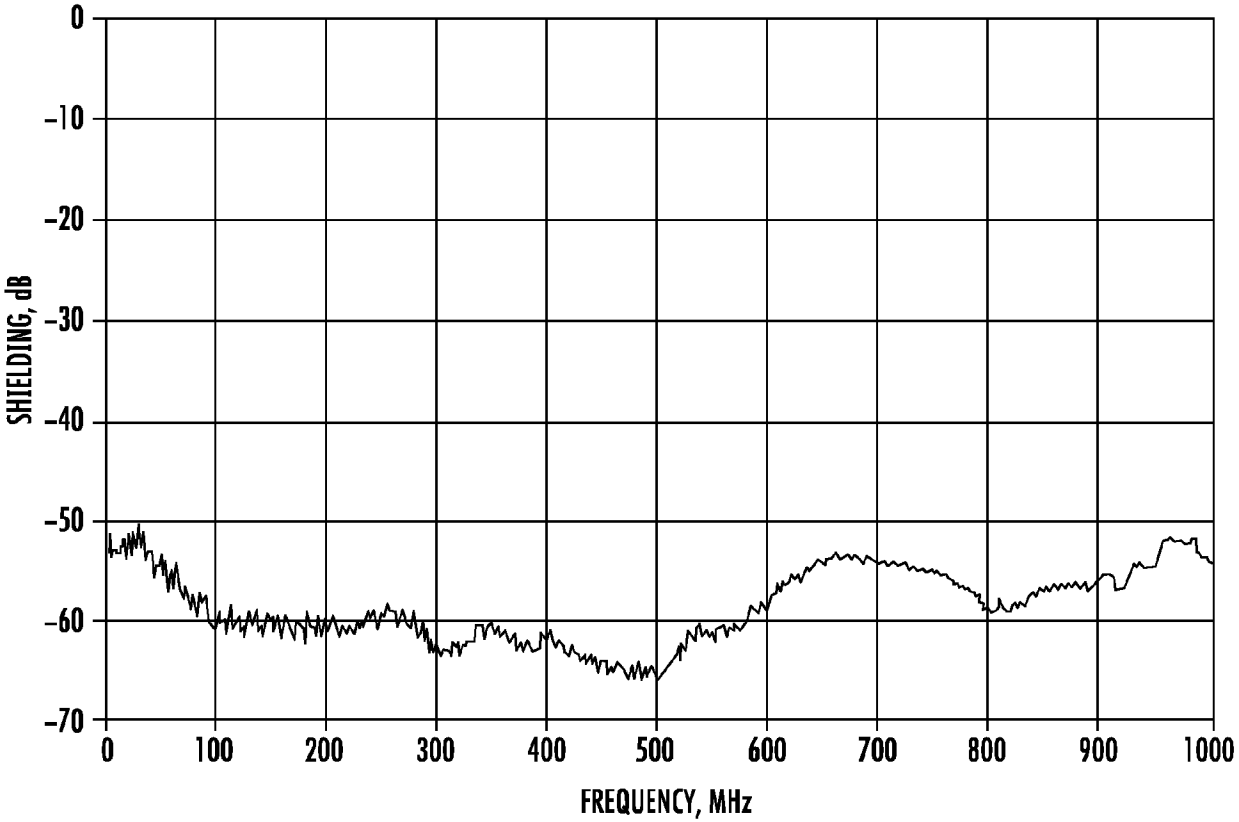
FIG. 31 is a graphic representation of the RF shielding of the coaxial cable connector in FIG. 26 in which the RF shielding is measured in dB over a range of frequency in MHz.

Referring now to FIG. 31, comparative RF shielding effectiveness in "dB" of coaxial cable connector 119 over a range of 0-1000 megahertz ("MHz") is illustrated. The coupling 200 was finger tightened on the equipment connection port 904 and then loosened two full turns. As illustrated in FIG. 30, the RF shielding in "dB" for coaxial cable connector 119 for all frequencies tested indicated that the RF signal was attenuated by more than 50 dB.

Additionally, the effectiveness of RF signal shielding may be determined by measuring transfer impedance of the coaxial cable connector. Transfer impedance is the ratio of the longitudinal voltage developed on the secondary side of a RF shield to the current flowing in the RF shield. If the shielding effectiveness of a point leakage source is known, the equivalent transfer impedance value can be calculated using the following calculation:

$$SE=20 \log Z_{total}-45.76 \text{ (dB)}$$

Accordingly, using this calculation the average equivalent transfer impedance of the coaxial cable connector 119 is about 0.24 ohms.

As discussed above, electrical continuity shall mean DC contact resistance from the outer conductor of the coaxial cable to the equipment port of less than about 3000 milliohms. In addition to increasing the attenuation of RF signals by closing off or reducing the RF leakage via paths 900, 902, the DC contact resistance may be substantially reduced. As a non-limiting example, the DC contact resistance may be less than about 100 milliohms, such as less than 50 milliohms, and, additionally, such as less than 30 milliohms, and further such as less than 10 milliohms.

Many modifications and other embodiments set forth herein will come to mind to one skilled in the art to which the embodiments pertain having the benefit of the teachings presented in the foregoing descriptions and the associated drawings. Therefore, it is to be understood that the description and claims are not to be limited to the specific embodiments disclosed and that modifications and other embodiments are intended to be included within the scope of the appended claims. For example, the embodiments disclosed herein can be employed for any type of distributed antenna system, whether such includes optical fiber or not.

It is intended that the embodiments cover the modifications and variations of the embodiments provided they come within the scope of the appended claims and their equivalents. Although specific terms are employed herein, they are used in a generic and descriptive sense only and not for purposes of limitation.

What is claimed is:

1. A coaxial cable connector for coupling an end of a coaxial cable to a terminal, the coaxial cable comprising an inner conductor, a dielectric surrounding the inner conductor, an outer conductor surrounding the dielectric, and a jacket surrounding the outer conductor, the connector comprising:

a coupler adapted to couple the connector to the terminal;

a body assembled with the coupler, a post assembled with the coupler and the body, wherein the post is adapted to receive an end of a coaxial cable, and a retainer assembled with the coupler, the body and the post, wherein the retainer extends into the body, wherein electrical continuity is established through the coupler, the post and the retainer other than by the use of a component unattached from the coupler, the post, the body and the retainer to provide RF shielding to maintain integrity of an electrical signal transmitted through the coaxial cable connector regardless of the tightness of the coupling of the connector to the terminal.

2. The coaxial cable connector of claim 1, wherein the RF shielding attenuates spurious RF signals by at least about 50 dB in a range up to about 1000 MHz.

3. The coaxial cable connector of claim 1, wherein a transfer impedance measured from the outer conductor of the coaxial cable to the terminal through the connector averages less than about 0.24 ohms.

4. The coaxial cable connector of claim 2, wherein the RF signals comprise RF signals that ingress into the connector.

5. The coaxial cable connector of claim 2, wherein the RF signals comprise RF signals that egress out from the connector.

6. The coaxial cable connector of claim 1, wherein the coupler comprises, a step, and a lip, and wherein one of the post and the retainer comprises, a flange, a contacting portion and a shoulder.

7. The coaxial cable connector of claim 6, wherein a first circuitous path is established by at least one of the step, the lip, the flange, the contacting portion and the shoulder, and wherein the first circuitous path attenuates the RF signals.

8. The coaxial cable connector of claim 6, wherein the contacting portion is integral to and monolithic with at least a portion of one of the post and the retainer.

9. The coaxial cable connector of claim 1, wherein the terminal comprises an equipment connection port, and wherein the coupler comprises a threaded portion adapted to connect with a threaded portion of the equipment connection port, and wherein at least one thread on the coupler has a pitch angle different than a pitch angle of at least one thread of the equipment connection port.

10. The coaxial cable connector of claim 9 wherein the pitch angle of the thread of the coupler is about 2 degrees different than the pitch angle of the thread of the equipment connection port.

11. The coaxial cable connector of claim 9, wherein the pitch angle of the thread of the coupler is about 62 degrees, and the pitch angle of the thread of the equipment connection port is about 60 degrees.

12. The coaxial cable connector of claim 9, wherein the threaded portion of the coupler and the threaded portion of the equipment connection port, establish a second circuitous path, and wherein the second circuitous path attenuates RF signals external to the connector.

13. A coaxial cable connector for coupling an end of a coaxial cable to an equipment connection port, the coaxial cable comprising an inner conductor, a dielectric surrounding the inner conductor, an outer conductor surrounding the dielectric, and a jacket surrounding the outer conductor, the connector comprising:

a coupler adapted to couple the connector to the equipment connection port;

a body assembled with the coupler, and a post assembled with the coupler and the body, wherein the post is adapted to receive an end of a coaxial cable; and a retainer; and a retainer assembled with the coupler and the body, the retainer extending into the body, and wherein the retainer comprises an integral contacting portion, and wherein the contacting portion is monolithic with the retainer, and wherein when assembled the coupler and the retainer provide at least one circuitous path resulting in RF shielding to attenuate spurious RF signals and maintain the integrity of an electrical signal transmitted through coaxial cable connector regardless of the tightness of the coupling of the connector to the terminal.

14. The coaxial cable connector of claim 13, wherein RF signals comprise at least one of RF signals that ingress into the connector and RF signals that egress out from the connector.

15. The coaxial cable connector of claim 13, wherein the RF signals are attenuated by at least about 50 dB in a range up to about 1000 MHz.

16. The coaxial cable connector of claim 13, wherein a transfer impedance averages about 0.24 ohms.

17. The coaxial cable connector of claim 13, wherein the at least one circuitous path comprises a first circuitous path and a second circuitous path.

18. The coaxial cable connector of claim 17, wherein the coupler comprises a lip and a step, and the retainer comprises a flange and a shoulder, and wherein the first circuitous path is established by at least one of the step, the lip, the flange, the contacting portion and the shoulder.

19. The coaxial cable connector of claim 17, wherein the terminal comprises an equipment connection port, and wherein the coupler comprises a threaded portion adapted to connect with a threaded portion of the equipment connection port, and wherein the threaded portion of the coupler and the threaded portion of the equipment connection port establish a second circuitous path.

20. The coaxial cable connector of claim 19, wherein at least one thread on the coupler has a pitch angle different than a pitch angle of at least one thread of the equipment connection port.

21. A coaxial cable connector for coupling an end of a coaxial cable to an equipment connection port, the coaxial cable comprising an inner conductor, a dielectric surrounding the inner conductor, an outer conductor surrounding the dielectric, and a jacket surrounding the outer conductor, the connector comprising:

a coupler adapted to couple the connector to the equipment connection port, wherein the coupler has a step, and wherein the coupler comprises a threaded portion adapted to connect with a threaded portion of the equipment connection port, and wherein at least one thread on the coupler has a pitch angle different than a pitch angle of at least one thread of the equipment connection port;

a body assembled with the coupler; and a retainer assembled with the coupler and the body, the retainer extending into the body, wherein the retainer comprises a back end and a contacting portion, and wherein the retainer is adapted to receive an end of a coaxial cable, and wherein the contacting portion is integral and monolithic with at least a portion of the retainer, wherein a first circuitous path is established by the a step, the flange, the contacting portion and the shoulder, and wherein a second circuitous path is established by the threaded portion of the coupler and the threaded portion of the equipment connection port, and wherein the first circuitous path and the second circuitous path provide for RF shielding of the assembled coaxial cable connector to attenuate RF signals external to the coaxial cable connector by at least about 50 dB in a range up to about 1000 MHz, and wherein a transfer impedance averages about 0.24 ohms, and wherein the integrity of an electrical signal transmitted through coaxial cable connector is maintained regardless of the tightness of the coupling of the connector to the equipment connection port.

22. The coaxial cable connector of claim 21, wherein the pitch angle of the thread of the coupler is about 2 degrees different than the pitch angle of the thread of the equipment connection port.

23. The coaxial cable connector of claim 22, wherein the pitch angle of the thread of the coupler is about 62 degrees, and the pitch angle of the thread of the equipment connection port is about 60 degrees.

* * * * *